US006978645B2

(12) United States Patent
Shimon

(10) Patent No.: US 6,978,645 B2
(45) Date of Patent: Dec. 27, 2005

(54) FREEWHEELING LOCK APPARATUS AND METHOD

(75) Inventor: Gary C. Shimon, Shorewood, WI (US)

(73) Assignee: Strattec Security Corporation, Milwaukee, WI (US)

( * ) Notice: Subject to any disclaimer, the term of this patent is extended or adjusted under 35 U.S.C. 154(b) by 17 days.

(21) Appl. No.: 10/602,012

(22) Filed: Jun. 23, 2003

(65) Prior Publication Data

US 2004/0255627 A1 Dec. 23, 2004

(51) Int. Cl.[7] ..... E05B 17/04
(52) U.S. Cl. ..... 70/379 R; 70/422
(58) Field of Search ..... 70/379 R, 379 A, 70/380, 419, 422, 222, 223

(56) References Cited

U.S. PATENT DOCUMENTS

| | | | |
|---|---|---|---|
| 2,016,602 | A | 10/1935 | Jacobi |
| 2,068,405 | A | 1/1937 | Gerald |
| 2,096,719 | A | 10/1937 | Johnstone |
| 2,666,322 | A | 1/1954 | Uher |
| 3,287,944 | A | 11/1966 | Crumb |
| 3,410,123 | A | 11/1968 | Jacobi |
| 3,524,335 | A | 8/1970 | George |
| 3,599,455 | A | 8/1971 | Pilvet |
| 3,637,243 | A | 1/1972 | Kitano et al. |
| 3,659,444 | A | 5/1972 | Wellekens |
| 3,739,611 | A | 6/1973 | Ignatjev |
| 3,863,476 | A | 2/1975 | Patriquin |
| 3,928,993 | A | 12/1975 | Epstein |
| 3,968,668 | A | 7/1976 | Epstein |
| 3,992,907 | A | 11/1976 | Pilvet |
| 4,369,642 | A | 1/1983 | Grell |
| 4,385,510 | A | 5/1983 | Harper |
| 4,446,709 | A | 5/1984 | Steinbach |
| 4,750,342 | A | 6/1988 | Nakai |
| 4,759,204 | A | 7/1988 | Neyret |
| 4,773,240 | A | 9/1988 | Foshee |
| 4,794,772 | A | 1/1989 | Falk et al. |
| 4,829,798 | A | 5/1989 | Roop |
| 4,903,512 | A | 2/1990 | Leroy et al. |
| 4,936,895 | A | 6/1990 | Leclerc et al. |
| 5,044,183 | A | 9/1991 | Neyret |
| 5,050,410 | A | 9/1991 | Claar et al. |
| 5,060,494 | A | 10/1991 | Moorhouse |
| 5,070,716 | A | 12/1991 | Whorlow |
| 5,161,397 | A | 11/1992 | Raybary |

(Continued)

FOREIGN PATENT DOCUMENTS

| | | |
|---|---|---|
| DE | 1960900 | 6/1970 |

*Primary Examiner*—Suzanne Dino Barrett
(74) *Attorney, Agent, or Firm*—Michael Best & Friedrich LLP

(57) ABSTRACT

In some embodiments of the present invention, a freewheeling lock apparatus and method are provided in which the freewheeling lock affords actuation of a device only in response to the use of an appropriate key. The locking mechanism can include a housing, a sleeve received at least partially within the housing, a lock cylinder received at least partially within the sleeve and having a locked configuration and an unlocked configuration, a guide engagable with the sleeve and with one or more tumblers or other projecting elements of the lock cylinder, and an actuator engaged with the lock cylinder for rotation therewith when the lock cylinder is rotated in the unlocked configuration, and moved by the sleeve to a position disengaged from the lock cylinder when the lock cylinder is rotated in the locked configuration.

34 Claims, 13 Drawing Sheets

U.S. PATENT DOCUMENTS 5,216,908 A 6/1993 Malvy
5,263,348 A 11/1993 Wittwer
5,265,453 A 11/1993 Konii et al.
5,285,667 A 2/1994 Fukasawa et al.
5,295,376 A 3/1994 Myers
5,295,377 A 3/1994 Moricz et al.
5,428,978 A * 7/1995 Tsukano ..... 70/386
5,570,599 A 11/1996 Konii
5,577,409 A 11/1996 Oyabu et al.
5,640,864 A 6/1997 Miyamoto
5,704,234 A 1/1998 Resch
5,732,580 A 3/1998 Garnault et al.
5,765,417 A 6/1998 Bolton
5,775,147 A 7/1998 Wittwer
5,907,963 A 6/1999 Myers et al.
5,911,766 A 6/1999 Lieb et al.
6,058,751 A 5/2000 Dimig et al.
6,439,016 B1 * 8/2002 Wittwer et al. ..... 703/379 R
6,481,255 B2 11/2002 Theriault et al.
6,523,382 B1 2/2003 Dimig et al.
6,684,672 B2 * 2/2004 Hermansson et al. ..... 70/379 R
6,711,924 B2 * 3/2004 Ritz ..... 70/422

* cited by examiner

FREEWHEELING LOCK APPARATUS AND METHOD

BACKGROUND OF THE INVENTION

A wide variety of keyed locks or locking mechanisms exist for preventing unauthorized or unwanted entry and/or use of various items and devices including without limitation vehicles, houses, drawers, doors, and the like. While conventional keyed locks and locking mechanisms are generally effective in preventing such unwanted entry and/or use, certain tools and methods have been devised to defeat or overcome the effectiveness of keyed locks in order to forcefully gain entry to and/or use of the locked item.

One well-known manner of overcoming a lock is to pick the lock. Picking a lock requires a great deal of knowledge about the internal workings of the particular lock being picked, and is often relatively time consuming. In addition, locks are continually being improved to make the process of picking certain types of locks extremely difficult, if not altogether impossible. Due to the inherent challenges of picking a lock, certain groups having primarily malicious intentions (most notably car thieves) have devised other commonly used methods for overcoming a lock. By inserting a rigid item (such as a screwdriver) into the lock instead of the appropriate key, and subsequently applying a sufficient torque to that item, many locks can be overcome by force. Such locks typically fail in one of two manners when forced as just described. In a first failure mode, the internal components of the lock (e.g. the lock tumblers, the lock cylinder, and the like) are broken such that the lock cylinder can be rotated with respect to the lock housing. Generally, rotation of the lock cylinder is all that is required to defeat many locks. In a second failure mode, the internal lock components remain intact while the lock housing itself breaks free of the structural item to which it is secured (e.g. a vehicle steering column or vehicle door). Oftentimes, dislodging the lock housing in this manner and rotating the entire lock assembly has the same effect as rotating the lock cylinder with respect to the housing, resulting in the lock being defeated.

In order to prevent the defeat of a lock by forcefully rotating the lock as just described, some lock designs employ strengthened lock components and strengthened connections between the lock and the object to which the lock is secured. However, these design changes have had limited success because the resulting locks are still subject to damage by increasingly forceful attempts to overpower the lock, and are often excessively robust and expensive to manufacture and install. Furthermore, strengthening of certain lock components can require a subsequent strengthening of other lock components, resulting in a costly and on-going cycle of lock re-design in an attempt to eliminate the "weakest link" in the lock system.

Other attempts to protect keyed locks and locking mechanisms from being overpowered include the development of freewheeling locks. Freewheeling locks are constructed such that rotation of the lock cylinder with substantially any item other than the correct key inserted causes the lock cylinder to disengage from those lock components needed to unlock the lock (e.g., a lock drive mechanism). In this way, forced rotation of the lock cylinder does not result in unlocking or overcoming the lock.

SUMMARY OF THE INVENTION

Some embodiments of the present invention provide for a locking mechanism that affords actuation of a device only in response to the use of an appropriate key, wherein the locking mechanism includes a housing defining a cavity and having a central axis, a first end, a second end, and a first cam surface; a sleeve received at least partially within the cavity, the sleeve including a second cam surface engageable with the first cam surface; a lock cylinder received at least partially within the sleeve and having a locked configuration and an unlocked configuration, the locked configuration corresponding to the presence of the appropriate key in the lock cylinder; a guide engaging the sleeve, the lock cylinder coupled for rotation with the guide when the lock cylinder is in the locked configuration and rotatable with respect to the guide when the lock cylinder is in the unlocked configuration; and an actuator releasably engagable with the lock cylinder, movable with respect to the housing, and adapted for driving connection with the device in the locked and unlocked states of the lock cylinder, the actuator engaged with the lock cylinder for rotation therewith when the lock cylinder is rotated in the unlocked configuration, and moved by the sleeve to a position disengaged from the lock cylinder when the lock cylinder is rotated in the locked configuration.

In other embodiments of the present invention a lock assembly is provided having a housing at least partially defining a cavity and having a central axis; a lock cylinder received at least partially within the cavity and having a locked configuration wherein a projecting element extends from the lock cylinder, and an unlocked configuration wherein the projecting element is retracted with respect to the lock cylinder, the lock cylinder rotatable with respect to the housing in both the locked and unlocked configurations; at least one guide defining at least two engagement surfaces and including a radially-extending drive projection, the projecting element extending between the engagement surfaces when the projecting element extends from the lock cylinder; a sleeve received at least partially within the cavity and surrounding at least some of the projecting elements, the sleeve defining an aperture that receives the drive projection to non-rotatably couple the sleeve to the guide and to afford axial movement of the sleeve with respect to the guide; and an actuator selectively coupled to the lock cylinder for rotation therewith in response to rotation of the lock cylinder in one of the locked and unlocked configurations.

In still other embodiments of the present invention a lock assembly is provided having a housing defining a cavity and having a central axis; an actuator rotatably coupled to the housing; a lock cylinder received within the cavity and including a first set of retractable protrusions, and a second set of retractable protrusions that is diametrically opposed to the first set of retractable protrusions, the lock cylinder having an unlocked configuration corresponding to the presence of a properly coded key in the lock cylinder, and a locked configuration corresponding to the absence of the properly coded key in the lock cylinder, at least one of the retractable protrusions having a position extended from the lock cylinder when the lock cylinder is in the locked configuration and a position retracted within the lock cylinder when the lock cylinder is in the unlocked configuration, the lock cylinder being rotatable with respect to the housing in both the locked and unlocked configurations; first and second diametrically opposed guides defining a pair of engagement surfaces for engagement with at least one retractable protrusion of a respective set of protrusions when the lock cylinder is rotated in the locked configuration; a substantially cylindrical sleeve surrounding at least some of the retractable protrusions and at least a portion of the first and second guides, the sleeve non-rotatably coupled to the guides and axially movable with respect to the guides; and an actuator selectively coupled to the lock cylinder for rotation therewith in response to rotation of the lock cylinder in one of the locked and unlocked configurations.

Still other embodiments of the present invention are introduced and described in greater detail below. Other features of the present invention will become apparent to those skilled in the art upon review of the following detailed description and drawings.

BRIEF DESCRIPTION OF THE DRAWINGS

The present invention is further described with reference to the accompanying drawings, which show embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

Figure 1:
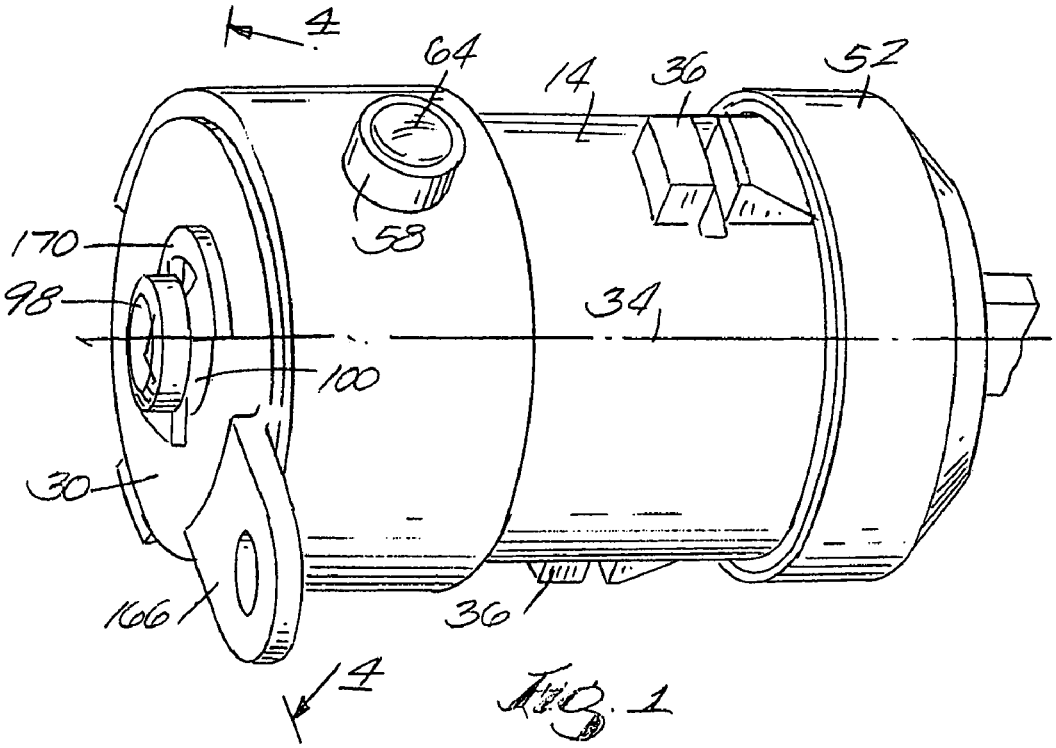
FIG. 1 is a perspective view of a freewheeling lock mechanism according to an embodiment of the present invention.
Figure 6:
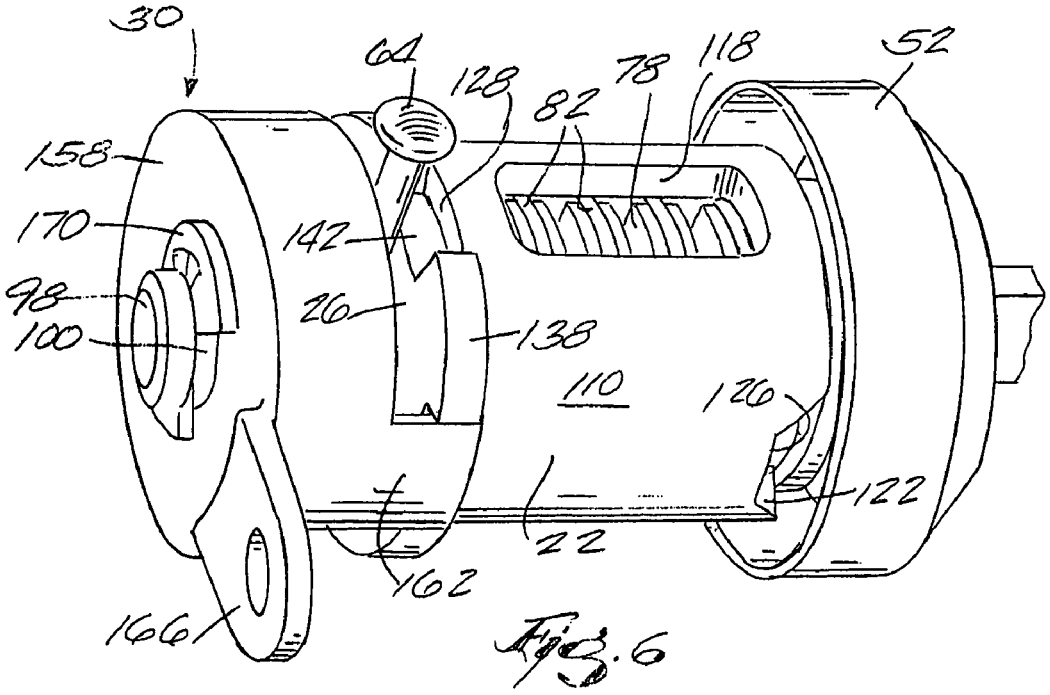
FIG. 6 is a perspective view of the freewheeling lock mechanism of FIG. 1, showing a portion of the freewheeling lock mechanism removed.

Before the various embodiments of the invention are described in detail, it is to be understood that the present invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION

Figure 2:
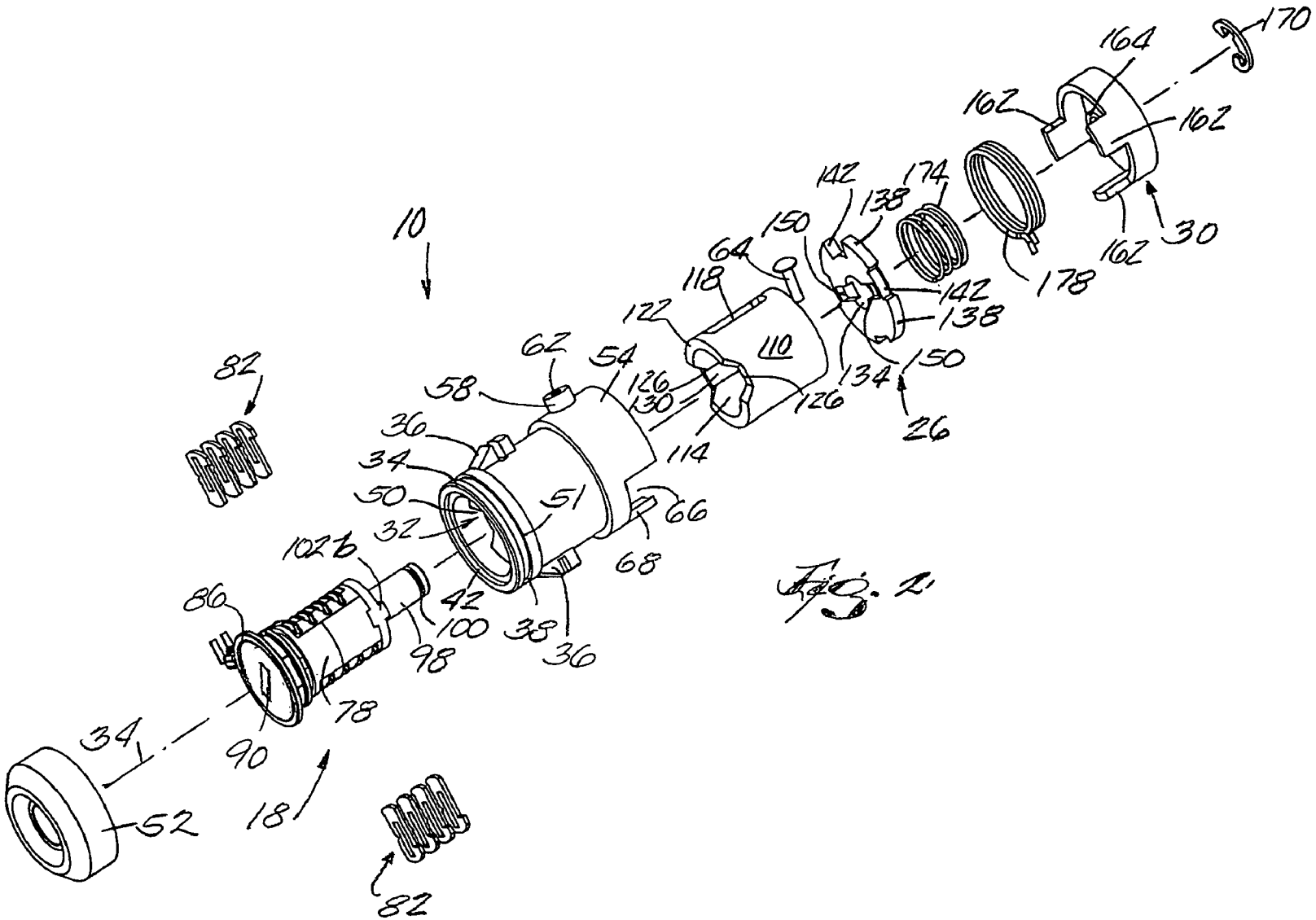
FIG. 2 is a front exploded perspective view of the freewheeling lock mechanism of FIG. 1.
Figure 3:
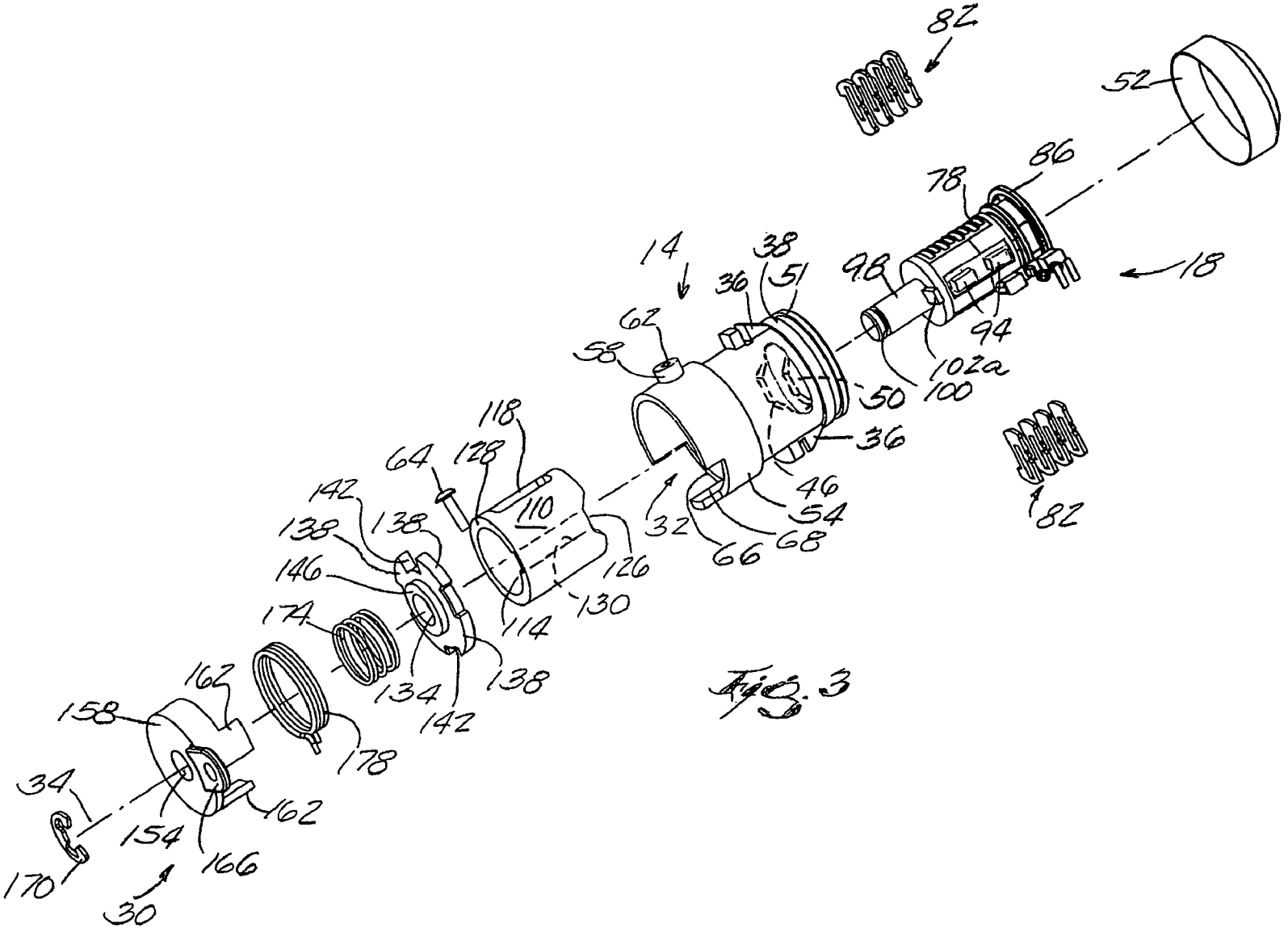
FIG. 3 is a rear exploded perspective view of the freewheeling lock mechanism of FIG. 1.

FIGS. 1–9 illustrate a locking mechanism 10 according to an embodiment of the invention. With reference to FIGS. 1–3, the locking mechanism 10 includes an outer housing 14, a lock cylinder 18 received within the housing 10, and a sleeve 22 also received with the housing 10 and surrounding at least a portion of the lock cylinder 18. The embodiment illustrated in FIGS. 1–9 also includes an intermediate engagement member in the form of a clutch disk 26, and an actuator element 30.

The housing 14 provides a generally cylindrical, open-ended cavity 32 and defines a central axis 34. In this regard, the housing 14 can take any shape within which the lock cylinder 18 can be received, and in some embodiments (such as that shown in the figures) is generally round. The housing 14 can enclose any amount of the lock cylinder 18 desired, such as by surrounding the length of the lock cylinder as shown in the figures.

The housing 14 can include outwardly extending mounting protrusions 36 that are securable to, among other things, a vehicle door or vehicle steering column that is to be lockably secured by the locking mechanism 10. The mounting protrusions 36 can take a variety of different forms and are generally determined by the device or mechanism (e.g. a vehicle part or assembly) to which the locking mechanism 10 is to be secured.

A cylinder-receiving end 38 of the housing 14 includes an internal lip 42 in the housing 14 for limiting travel of the sleeve 22 toward the cylinder-receiving end 38 of the housing 14. In other embodiments, sleeve travel in this direction can be limited in any other manner desired, such as by one or more bosses, pins, neck portions, and other features of the housing 14 (as well as element attached to the housing 14), each of which falls within the spirit and scope of the present invention.

For purposes that will be described in greater detail below, the housing 14 also includes a cam surface 46 extending radially into the cavity 32 and facing axially away from the receiving end 38. The cam surface 46 defines one or more axially extending cam projections 50 within the cavity 32. In some embodiments of the invention, the cylinder-receiving end 38 further includes an outer groove 51 that is configured to engage an end cap 52 of the locking mechanism 10. The end cap 52 can be shaped to generally overlie and surround the cylinder-receiving end 38 of the housing 14 when engaged with the outer groove 51. Alternatively, the end cap 52 (where used) can be directly or indirectly attached to the housing 14 in any other conventional manner.

Opposite the cylinder-receiving end 38 of the housing 14 is a retaining end 54. The retaining end 54 of the housing 14 can be the same size as the cylinder-receiving end 38 or can have any other size desired, and in some embodiments (such as that illustrated in the figures) is somewhat diametrically enlarged with respect to the receiving end 38 of the housing 14.

For purposes that will be described below, the retaining end 54 of the housing 14 illustrated in the figures includes a radially outwardly extending boss 58 that surrounds a through hole 62 communicating with the cavity 32. The through hole 62 receives a pin 64 that extends radially into the cavity 32. Although the boss 58 is not required, the boss 58 provides strength for the housing 14 adjacent to the pin 64. The retaining end 54 can also include one or more axially and circumferentially extending notches or cutouts 66 that define a return-spring reaction tab 68 on the housing 14.

The lock cylinder 18 is received within the cavity 32 and can take any conventional lock cylinder form. By way of example, the lock cylinder 18 in the illustrated embodiment includes a barrel portion 78 that houses a plurality of lock tumblers 82. Other types of tumbler or pin-type lock cylinders can be employed in conjunction with the present invention as desired. Although the lock cylinder 18 can have any shape, the lock cylinder 18 illustrated in the figures includes an end flange 86 that seats against the internal lip 42 in the housing 14 when the lock cylinder 18 is inserted into the cavity 32. The internal lip 42 assists in properly positioning the lock cylinder 18 with respect to the housing 14, and can be replaced with any number of other elements and structure capable of performing the same function (including those described above with reference to the internal lip 42).

At one end of the lock cylinder 18 is a key slot 90 that receives a key (not shown). When an appropriate key is inserted into the lock cylinder 18, the lock tumblers 82 engage the key and move within the barrel portion 78 to predetermined positions such that the lock cylinder 18 is placed in an unlocked state. If no key or an incorrect key is inserted into the lock cylinder 18, one or more of the lock tumblers 82 will be improperly positioned, and the lock cylinder 18 will remain in a locked state.

In some embodiments of the present invention, the lock cylinder 18 also includes a sidebar 94 that radially extends from the barrel portion 78 when the lock cylinder 18 is in the locked state. In such embodiments, the sidebar 94 can be operatively coupled to the lock tumblers 82 such that when the appropriate key is inserted and the lock tumblers 82 move to their predetermined positions, the sidebar 94 moves radially inwardly with respect to the barrel portion 78 to a retracted position corresponding to the unlocked state of the lock cylinder 18. In alternate embodiments of the present invention, such a sidebar is not employed. Instead, when the lock cylinder 18 is in the locked state, one or more of the tumblers 82 extend radially outwardly from the lock cylinder 18 to engage a housing or other adjacent element and to thereby prevent rotation of the lock cylinder 18. When an appropriate key is inserted into the lock cylinder 18, all of the tumblers are retracted into the barrel portion 78 to permit rotation of the lock cylinder 18. The specific operation of and interaction between the key and the lock tumblers 82 (as well as between the lock tumblers 82 and the sidebar 94, where employed) are well known in the art and are therefore not discussed further herein. While one specific type of lock cylinder 18 is illustrated in the drawings, substantially any type of rotatable lock cylinder is suitable for use with the present invention.

The lock cylinder 18 in the illustrated embodiment also has an axially extending boss 98 (substantially aligned with the central axis 34 when the lock cylinder 18 is received within the cavity 32) that helps to maintain the position of the lock cylinder 18 in the locking mechanism 10. The boss 98 can have any shape desired, such as the generally cylindrical shape shown in the figures. With continued reference to the illustrated embodiment, one or more dogs 102 extend axially away from the barrel portion 78 and radially outwardly from the boss 98. As illustrated, two dogs 102*a*, 102*b* are provided at substantially diametrically opposed positions, one of which (102*a*) is substantially radially aligned with the sidebar 94. The dog 102*a* is configured to extend radially beyond the barrel portion 78 such that the dog 102*a* and the sidebar 94 extend from the barrel portion (substantially the same distance in the illustrated embodiment) when the lock cylinder 18 is in the locked condition and the sidebar 94 is extended. In some embodiments, the boss 98 includes a circumferential groove 100 extending around its distal end for receiving a clip 170 that retains the elements of the locking mechanism 10 in their proper relative positions.

The sleeve 22 in the illustrated embodiment is generally tubular and is received within the annular space formed between the housing 14 and the lock cylinder 18 when the lock cylinder 18 is inserted into the cavity 32. An outer surface 110 of the sleeve 22 faces the housing 14, and an inner surface 114 of the sleeve 22 faces the barrel portion 78 of the lock cylinder 18. The sleeve 22 has at least one aperture or recess 118 within which tumblers 82 of the lock cylinder 18 can be received. The sleeve 22 can have a single aperture or recess 118 in those embodiments of the present invention having one set of tumblers 82 located in one circumferential position in the lock cylinder 18. Alternatively, the sleeve 22 can have multiple apertures or recesses 118, such as where multiple sets of tumblers 82 are located in different circumferential locations in the lock cylinder 18. For example, the sleeve 22 in the illustrated embodiment has two diametrically opposed elongated slots 118 corresponding to two sets of tumblers 82.

The apertures or recesses 118 in the sleeve 22 can have substantially any shape and can be positioned substantially anywhere along the sleeve 22. In some embodiments of the invention, the apertures or recesses 118 may be excluded altogether. The shape and positioning of the apertures or recesses 118 is largely dependent upon the configuration of the lock cylinder 18. By way of example only, the sleeve 22 in the illustrated embodiment has two axially elongated slots 118 for receiving the lock tumblers 82 that extend beyond the barrel portion 78 when the lock cylinder 18 is in the locked state. When the tumblers 82 are extended into the elongated slots 118, the tumblers 82 prevent rotation of the lock cylinder 18 with respect to the sleeve 22. The axially elongated slots 118 can also perform drainage functions for the locking mechanism 10.

One end of the sleeve 22 includes a generally annular cam surface 122 that engages the cam surface 46 of the housing 14. The cam surface 122 provides one or more axial cam recesses 126 that are configured to receive one or more cam projections 50 of the housing 14. The other end of the sleeve 22 includes a generally annular clutch-engaging surface 128 that slidingly engages the clutch disk 26, depending upon the state (e.g. locked or unlocked) of the lock cylinder 18. As will be described further below, the "clutch" portion of the lock mechanism is provided by the sleeve 22 and the disk 26, which selectively drivingly or slidingly engage one another.

For those embodiments of the preset invention employing a sidebar 94 as described above, the sleeve 22 can also include an aperture or recess 130 for receiving the sidebar 94. As with the apertures or recesses 118 of the sleeve 22, the aperture or recess 130 for the sidebar 94 can have any shape and location suitable for receiving the sidebar 94. In the illustrated embodiment for example, the aperture or recess 130 is an axially extending groove 130 recessed with respect to the inner surface 114 for receiving the sidebar 94 when the sidebar 94 is extended. In some embodiments of the invention, the engagement between the sidebar 94 and the aperture or recess 130 alleviates the need for engagement between the tumblers 82 and the apertures or recesses 118. In this respect, some embodiments of the invention can include tumblers 82 that do not extend from the lock cylinder 18 regardless of the condition (e.g. locked or unlocked) of the lock cylinder 18.

Figure 4:
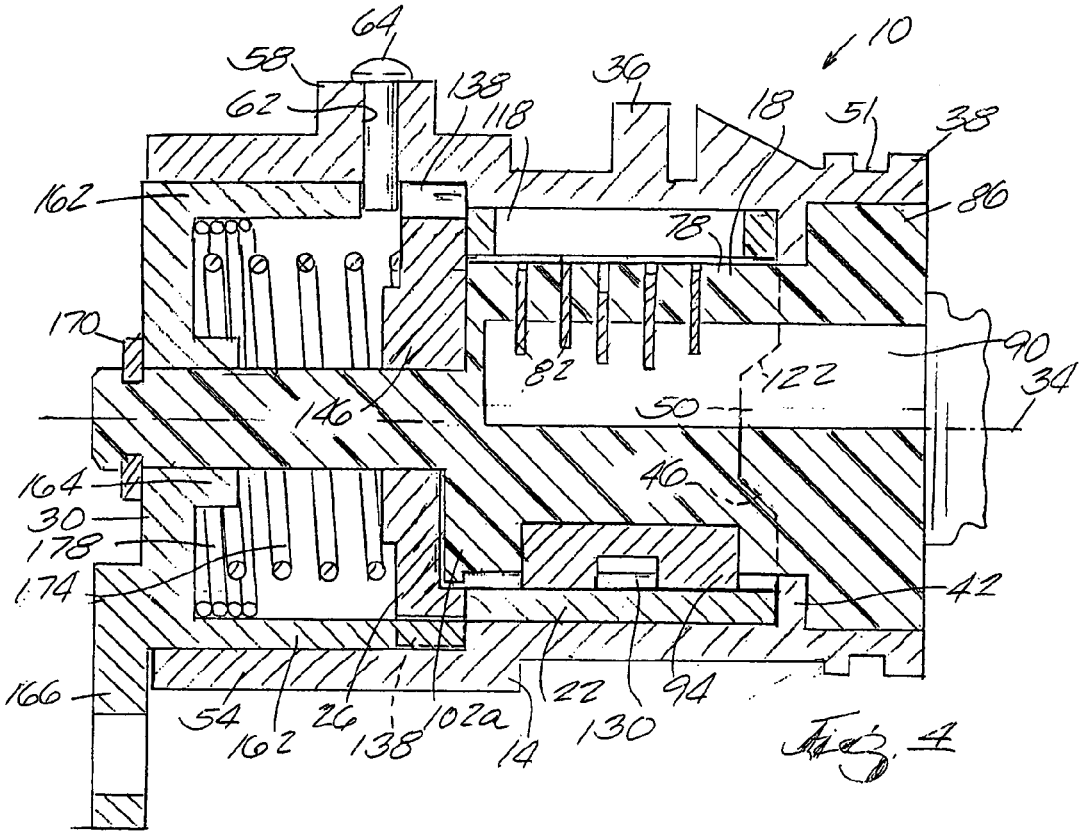
FIG. 4 is a cross-sectional view of the freewheeling lock mechanism of FIG. 1, taken along line 4—4 of FIG. 1.

With continued reference to the illustrated embodiment of the present invention, the overall length of the sleeve 22 is selected such that when the end flange 86 of the lock cylinder 18 is engaged with the internal lip 42 of the housing 14, the cam projections 50 are aligned with and received by the cam recesses 126, and the dogs 102*a*, 102*b* of the lock cylinder 18 extend axially beyond the clutch-engaging surface 128 toward the retaining end 54 of the housing 14 (see FIG. 4).

The engagement member or clutch disk 26 can have any shape desired, dependent at least partially upon the shape and position of the boss 98 and the sleeve 22. With reference to FIGS. 2 and 3 for example, the engagement member or clutch disk 26 is generally round, is received by the retaining end 54 of the housing 14 and includes a central aperture 134 that receives the boss 98 of the lock cylinder 18. The clutch disk 26 can include two or more (e.g. four as illustrated) radially extending protrusions 138 that define substantially equally angularly spaced apart cutouts or notches 142 therebetween. In some embodiments, one side of the clutch disk 26 includes a substantially annular protrusion 146 that surrounds the central aperture 134, while the other side of the clutch disk 26 includes one or more axial recesses 150 that extend radially outwardly from the central aperture 134. In the illustrated embodiment for example, the clutch disk 26 includes two recesses 150 that are substantially diametrically opposed to each other (although other numbers and arrangements of such recesses 150 are possible depending at least in part upon the number and arrangement of the dogs 102*a*, 102*b* on the lock cylinder 18). The recesses 150 are adapted and configured to receive the dogs 102*a*, 102*b* of the lock cylinder 18, such that rotational movement of the lock cylinder 18 is transmitted to the clutch disk 26 due to driving engagement between the dogs 102*a*, 102*b*, and the recesses 150.

The actuator element 30 can perform a single function or can perform two or more functions. For example, the actuator element 30 can be employed to retain elements of the locking mechanism 10 in place, can be employed to connect the locking mechanism 10 to the device controlled thereby, and/or can be employed to assist in properly positioning the lock cylinder 18 within the locking mechanism 10. In the illustrated embodiment, the actuator element 30 has at least some portion that is received by the retaining end 54 of the housing 14 and includes a central aperture 154 that receives the boss 98 of the lock cylinder 18. The actuator element 30 can include an end wall 158 that defines the end of the locking mechanism 10.

The actuator element 30 can also include one or more (e.g. three as illustrated) angularly spaced-apart dogs or projections 162 that extend axially inwardly with respect to the cavity 32, as well as a protrusion 164 (e.g., an annular projection as shown in the figures) that also extends axially inwardly with respect to the cavity 32. The axial dogs or projections 162 can take any shape desired, including rod-shaped or bar-shaped elements extending from the actuator element 30. However, in some embodiment such as that shown in the figures, the axial dogs or projections 162 are shaped to match features of the clutch disk 26 with which they mate.

If employed, the protrusion 164 can surround any part or all of the aperture 154. Also if employed, the projections 162 can be shaped and arranged to extend into the notches 142 formed in the clutch disk 26 such that rotational movement of the clutch disk 26 (e.g. in response to rotational movement of the lock cylinder 18 and driving engagement of the dogs 102*a*, 102*b* and the recesses 150) imparts rotational movement to the actuator element 30 due to driving engagement between the projections 162 and the clutch protrusions 138. For reasons that will become apparent below, at least one of the notches 142 in the clutch disk 26 is not engaged or otherwise occupied by the projections 162.

The lock mechanism 10 can be connected to a latch or other mechanism to be locked by a number of different elements and structure on the lock mechanism 10. By way of example only, the lock mechanism 10 in the illustrated embodiment has a lock output tab 166 extending from the actuator element 30. More specifically, the actuator element 30 in this embodiment includes a lock output tab 166 extending axially and radially away from the end wall 158. The lock output tab 166 can be connected to, among other things, a latching device or an ignition switch for a vehicle such that rotational movement of the actuator element 30 moves the lock output tab 166 and locks/unlocks a connected device. As an alternative to a lock output tab 166, the actuator element 30 can have an actuator shaft extending axially from the actuator element 30, substantially aligned with the central axis 34 of the locking mechanism 10 and coupled to a vehicle ignition, door latch, or other mechanism for locking and unlocking the mechanism by rotation of the actuator shaft. In still other embodiments, the actuator element 30 can have one or more apertures, bosses, flanges, fingers, or other connecting points to which one or more cables, rods, levers, or other elements can be connected for transmitting motion from the locking mechanism 10 to a device connected thereto.

The above-described lock output tab 166, axially extending shaft, and alternative connecting points of the actuator element 30 are only a small number of examples of lock output mechanisms. Many elements and mechanisms for transmitting rotational movement of the lock mechanism to rotational, translational, and other types of movement for actuation of various devices (e.g. door latches and vehicle ignitions) are well known to those skilled in the art. Each of these actuating elements and devices can be used in combination with the teachings of the present invention and fall within the spirit and scope of the present invention. The use of the locking mechanism 10 in a vehicle and/or for locking and unlocking a door latch is merely exemplary. Many other uses and applications for the locking mechanism 10 according to the present invention would be contemplated by those of skill in the art.

As mentioned above, the end of the boss 98 extending away from the barrel portion 78 of the lock cylinder 18 has a circumferential groove 100 for receiving a clip 170. In this regard, when the locking mechanism illustrated in the figures is assembled (see FIGS. 4 and 5), a portion of the lock cylinder boss 98 extends beyond the end wall 158 of the actuator element 30 such that the circumferential groove 100 in the end of the boss 98 is exposed. The retaining element 170 (e.g., a C or E-clip, a retaining ring, and the like) is positioned in the circumferential groove 100 to secure the components of the locking mechanism 10 within the housing 14. In other embodiments of the present invention, the boss 98 (or at least the end thereof) can be threaded so that a nut or other conventional fastener can used in place of or in addition to the retaining element 170. In still other embodiments, the actuator element 30 is retained in place with respect to the housing 14 and the other elements of the locking mechanism 10 by one or more inter-engaging lips and grooves (e.g., a circumferential groove in the housing 14 within which a flange, lip, rib, or other circumferential protrusion of the actuator element 30 extends, and the like). Still other manners of connection between the actuator element 30 and the lock cylinder 18 are possible, each permitting relative rotation between the actuator element 30 and the housing 14 and each falling within the spirit and scope of the present invention.

In some embodiments of the present invention such as that shown in the figures, it is desirable to bias the clutch disk 26 toward the sleeve 22. A number of different spring elements in a number of different locations can be employed for this purpose. In the illustrated embodiment for example, the locking mechanism 10 includes a biasing element in the form of a helical compression spring 174 located between the clutch disk 26 and the actuator element 30. In other embodiments, other types of spring elements can be employed, such as leaf springs, resilient bushings, Belleville washers, and the like. The spring 174 in the illustrated embodiment surrounds and receives the annular protrusions 146, 164, although such protrusions are not required to bias the clutch disk 26 as described above. The spring 174 is compressed between the clutch disk 26 and the actuator element 30 such that a biasing force is applied to the clutch disk 26, thereby biasing the clutch disk recesses 150 into engagement with the lock cylinder dogs 102*a*, 102*b*. In addition to biasing the clutch disk 26 into engagement with the lock cylinder 18, the spring 174 can also provide a biasing force between the lock cylinder 18 and the actuator element 30, thereby reducing the amount of rattling that occurs between various lock components of the locking mechanism 10.

In addition to the compression spring 174, another biasing element can also be provided to bias the lock cylinder 18 and/or the actuator element 30 toward a predetermined angular orientation with respect to the housing 14. For example, a torsion spring 178 can be connected to the housing 14 and to the actuator element 30 or clutch disk 26 to bias the actuator element 30, clutch disk 26, and lock cylinder 18 toward an unactuated position. In the illustrated embodiment, the torsion spring 178 engages the reaction tab 68 on the housing 14 and at least one of the projections 162 of the actuator element 30 in such a way that rotation of the actuator element 30 with respect to the housing 14 creates an angular biasing force in the torsional spring 178. The biasing force acts against rotation of the actuator element 30 and urges the actuator element 30 back toward its original angular position. One having ordinary skill in the art will appreciate that other types of springs and spring elements can be employed to urge the actuator element 30 and/or lock cylinder 18 to an unactuated position with respect to the housing 14, and that such springs and spring elements can be connected to provide this biasing force in a number of different manners, each one of which falls within the spirit and scope of the present invention. For example, some embodiments of the invention can include a single spring that functions as the compression spring 174 and the torsion spring 178.

In some embodiments, it is desirable to limit movement of the actuator element 30 in the unlocked state of the locking mechanism 10 and/or to limit movement of the clutch disk 26 in the locked state after the dogs 102*a*, 102*b* of the lock cylinder 18 are disengaged from the clutch disk 26. In the embodiment shown in FIGS. 1–9, the pin 64 of the locking mechanism 10 provides this limit. The through hole 62 (see FIGS. 4 and 5) in the housing, and therefore the pin 64, is positioned such that when the lock cylinder 18 has not been rotated, the pin 64 is substantially angularly aligned with one of the notches 142 in the clutch disk 26 (see FIG. 6). Specifically, the pin 64 is radially aligned with the notch 142 that is not engaged or occupied by the axial projections 162 of the actuator element 30. In addition, the pin 64 is axially offset from the clutch disk 26 toward the retaining end 54 of the housing 14.

Figure 9:
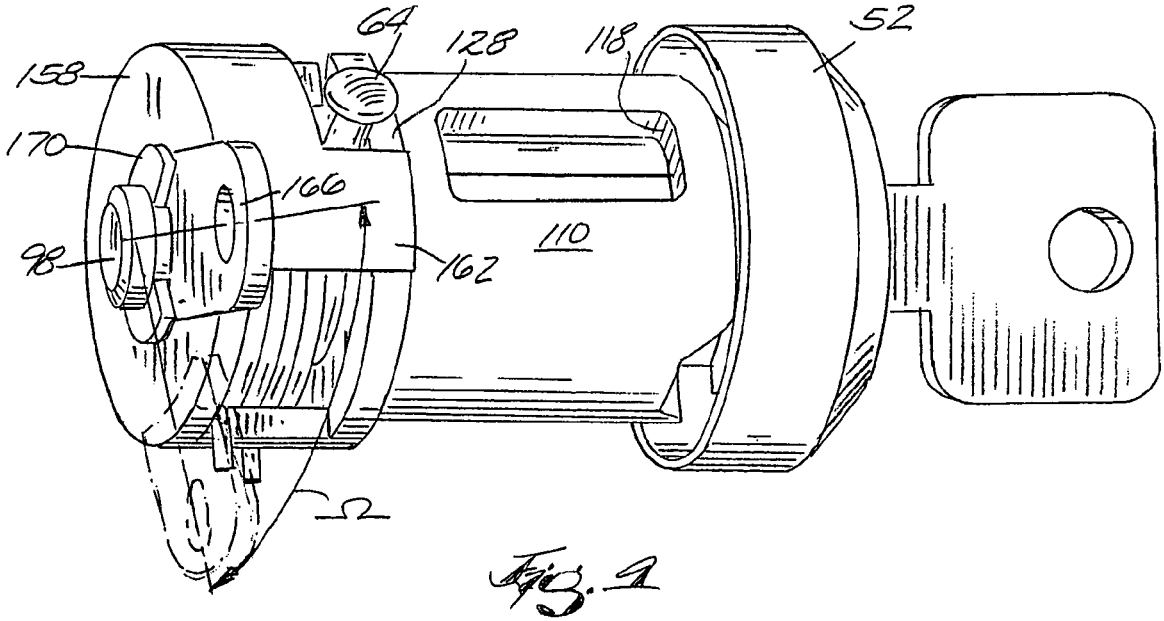
FIG. 9 is a perspective view of the freewheeling lock mechanism of FIG. 6, shown fully rotated in an unlocked condition.
Figure 10:
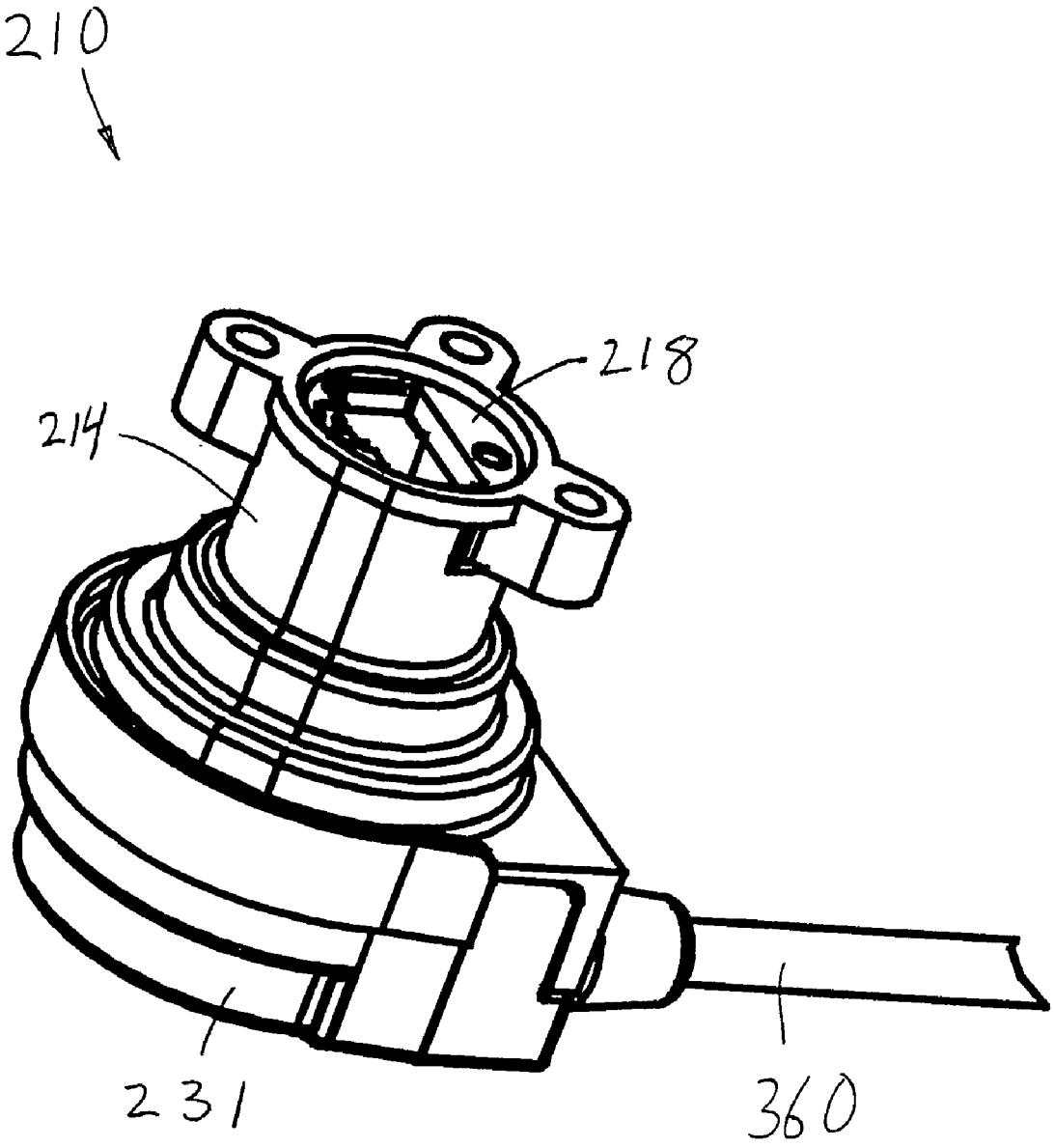
FIG. 10 is a perspective view of a freewheeling lock mechanism according to another embodiment of the present invention.

If the lock cylinder 18 is rotated with the proper key inserted, the actuator element 30 will rotate until one of the actuator element projections 162 engages the pin 64, thereby preventing further rotation of the actuator element 30 and lock cylinder 18 (see FIG. 9). The pin 64 and projection 162 are configured to allow sufficient rotation of the actuator element 30 (e.g. through the angle Omega) such that the device to which the actuator element 30 is coupled (e.g. a door latch, a vehicle ignition switch, and the like) can be effectively actuated. As will be described in greater detail below, if the lock cylinder 18 is rotated without the proper key inserted, the clutch disk 26 is axially moved until the pin 64 is received within a notch 142 of the clutch disk to prevent frictional engagement of the sleeve 22 and clutch disk 26 from turning the clutch disk 26 (or at least to limit the rotation of the clutch disk 26).

Given the arrangement and configuration of the various components described above, the locking mechanism 10 provides free rotation of the lock cylinder 18 within the housing 14 when an attempt to rotate the lock cylinder 18 is made using substantially any item other than the appropriate key (e.g. the wrong key, a screwdriver, or the like). As used herein, "free rotation" of the lock cylinder 18 is means that rotation of the lock cylinder 18 does not impart significant rotational movement to the actuator element 30 or otherwise imparts insufficient rotational movement to the actuator element 30 to fully actuate the device connected to the locking mechanism 10. By restricting the amount of rotational movement transmitted from the lock cylinder 18 to the actuator element 30 to a relatively small angle (e.g. the angle alpha of FIG. 7, which is significantly smaller than the angle Omega of FIG. 9), operation of the device or mechanism to which the actuator element 30 is coupled is precluded. Of course, if the appropriate key is inserted into the lock cylinder 18, rotation of the lock cylinder 18 results in less restricted rotation (and in some embodiments, unrestricted rotation) of the actuator element until such time as the actuator element projection 162 engages the pin 64. Accordingly, by using the appropriate key, the locking mechanism 10 is fully operational to lock/unlock or activate/deactivate the associated device or mechanism to which the actuator element 30 is coupled.

Figure 5:
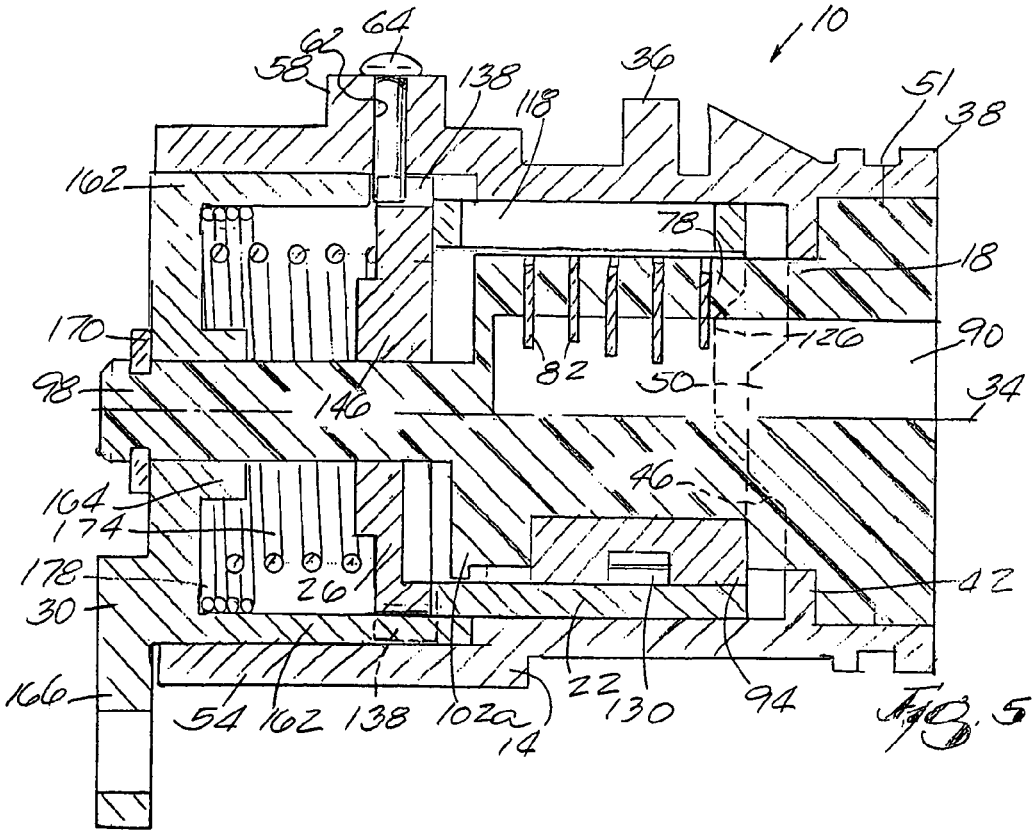
FIG. 5 is a cross-sectional view of the freewheeling lock mechanism of FIG. 1, taken along line 5—5 of FIG. 7.
Figure 7:
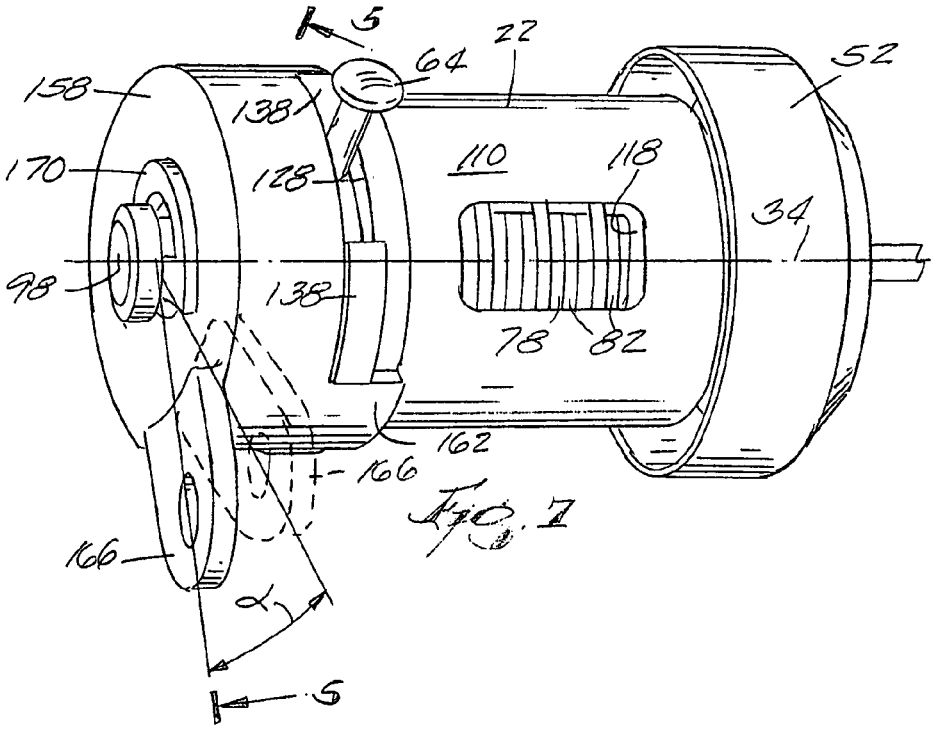
FIG. 7 is a perspective view of the freewheeling lock mechanism of FIG. 6, shown rotated in a locked condition.
Figure 8:
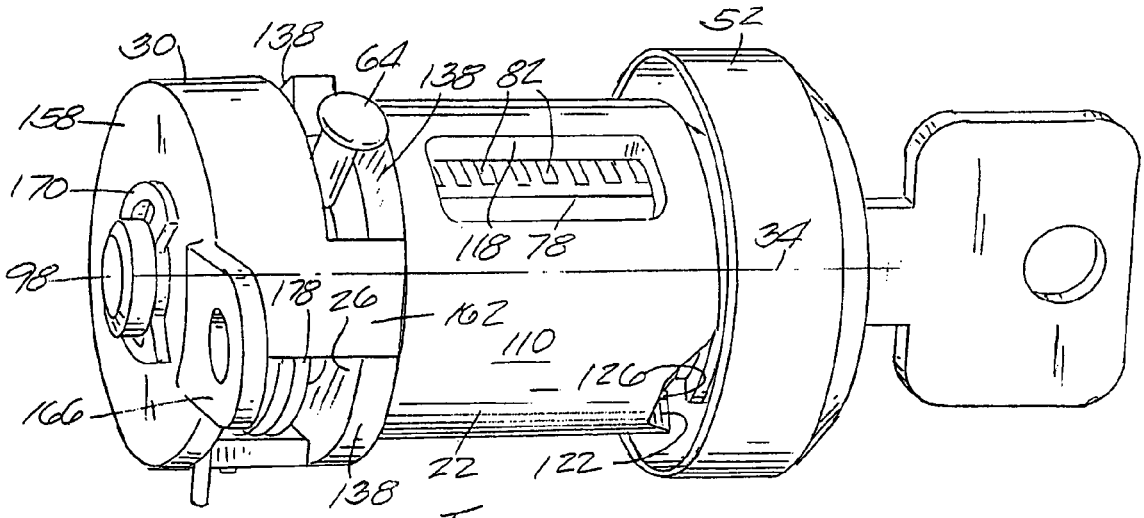
FIG. 8 is a perspective view of the freewheeling lock mechanism of FIG. 6, shown partially rotated in an unlocked condition.

With continued reference to the embodiment of the present invention illustrated in FIGS. 1–8, when substantially any item other than the appropriate key is used to rotate the lock cylinder 18, the lock cylinder 18 remains in the locked condition such that the sidebar 94 remains extended and projects into the groove 130 in the sleeve 22 (see FIGS. 4 and 5). As such, the lock cylinder 18 and the sleeve 22 are substantially rotatably fixed to each other. In alternative embodiments, the tumblers 82 may also or alternatively extend from the lock cylinder 18 and project into the slots 118 to rotatably fix the lock cylinder 18 to the sleeve 22. In response to coupled rotation of the lock cylinder 18 and the sleeve 22 together, the cam projections 50 in the housing 14 and the cam recesses 126 in the sleeve 22 engage each other and urge the sleeve 22 axially toward the retaining end 54 of the housing 14.

As the sleeve 22 moves axially along the housing 14, the clutch-engaging surface 128 of the sleeve 22 engages the clutch disk 26 such that the clutch disk 26 is urged against the biasing force of the compression spring 174 axially toward the retaining end 54 of the housing 14. As the clutch disk 26 moves axially in this manner, the clutch recesses 150 become disengaged from the dogs 102*a*, 102*b*. At this time, the lock cylinder 18 and the clutch disk 26 are no longer drivingly coupled for rotation together. In addition, movement of the sleeve 22 as described above brings the sleeve groove 130 over the radially extending drive dog 102*a*, thereby bringing the sleeve groove 130 and drive dog 102*a* into driving relationship. Substantially simultaneously, and also due to axial movement of the clutch disk 26, the clutch disk notch 142 that is not occupied by one of the actuating element projections 162 receives the pin 64.

The angle of rotation of the clutch disk 26 (and therefore, of the actuator element 30 in its locked state) can vary widely depending at least in part upon the size of the notch 142 and the radial clutch protrusions 138. Similarly, the angle of rotation of the actuator element 30 in its unlocked state can vary widely depending at least in part upon the distance between the pin 64 and the axial projection 162 that limits movement of the actuator element 30. In some embodiments, the angle of rotation of the clutch disk 26 in the locked state of the locking mechanism 10 is less than about 30 degrees. In other embodiments, this angle is about 15 degrees or less.

Once the clutch protrusion 138 engages the pin 64 in the locked state of the locking mechanism 10, further rotation of the clutch disk 26 is prevented. During axial movement of the clutch disk 26 in some embodiments, the clutch notches 142 and the axial projections 162 of the actuator element 30 slide axially with respect to each other such that there is substantially no axial movement of the actuator element 30 with respect to the housing 14. The locking mechanism 10 and the device to which the mechanism 10 is attached are configured such that the small amount of actuator element rotation that occurs as the clutch disk 26 is disengaged from the lock cylinder 18 does not fully operate, actuate, or otherwise influence the state (e.g., locked or unlocked) of the device.

With continued reference to the embodiment illustrated in FIGS. 1–9, as the lock cylinder 18 and the sleeve 22 continue to rotate together, the cam recesses 126 disengage the cam projections 50, and the clutch recesses 150 disengage the dogs 102*a*, 102*b* (see FIG. 5). Also, the clutch disk 26 and the actuator element 30 remain substantially stationary (both axially and rotationally) with respect to the housing 14 due to engagement between the clutch disk 26 and the pin 64 while the clutch-engaging surface 128 slidingly engages the clutch disk 26. In the illustrated embodiment having two cam recesses 126 and two cam projections 50, once the lock cylinder 18 and the sleeve 22 have been rotated approximately 180 degrees, the cam recesses 126 and cam projections 50 are once again aligned (albeit with an opposite cam recess 126 and cam projection 50) and the biasing force of the compression spring 174 urges the clutch disk 26 and the sleeve 22 axially toward the cylinder-receiving end 38 of the housing 14, thereby re-engaging the cam recesses 126 with the cam projections 50, and the clutch recesses 150 with the lock cylinder dogs 102*a*, 102*b*. Still further rotation of the lock cylinder 18 in a forceful manner repeats the disengagement/re-engagement cycle. Accordingly, the lock cylinder 18 can by continuously rotated by an improper key or other object without imparting significant rotational force to the actuator element 30, tumblers 82, or sidebar 94, thereby preventing alteration of or damage to the locking mechanism 10 and preventing the device connected thereto from becoming unlocked. Regardless of whether the lock cylinder 18 is rotated in the locked or unlocked condition, the lock cylinder 18 remains substantially axially fixed with respect to the housing.

In other embodiments of the present invention in which fewer or more apertures or recesses 118, 130 are provided in the sleeve 22, the lock cylinder 18 can be rotated different amounts before being re-engaged with the housing 14 in a manner similar to that described above. For example, in embodiments having a single set of tumblers 82 and a single elongated aperture 118 in the sleeve 22, the lock cylinder 18 can be rotated approximately 360 degrees to become re-engaged with the sleeve 22.

In some embodiments, if the lock cylinder 18 is forcibly rotated when in the locked condition through a sufficient angle to result in axial translation of the sleeve 22, but not so far as to allow the lock cylinder dogs 102*a*, 102*b* to re-engage with the clutch recesses 150, engagement between the radially extending cylinder dog 102*a* and the sidebar groove 130 of the sleeve 26 facilitates returning the lock to an operative mode using the appropriate key. Specifically, when the appropriate key is inserted into a partially rotated lock cylinder 18, the sidebar 94 and/or the tumblers 82 (depending upon the configuration of the lock cylinder 18) are retracted from the groove 130 and/or the elongated apertures 118, respectively, so that the sidebar 94 and/or the tumblers 82 no longer couple the sleeve 22 and the lock cylinder 18 for rotation together. With this in mind, the radially extending dog 102*a* and the groove 130 are configured to couple the lock cylinder 18 and the sleeve 22 for rotation together when the sidebar 94 and/or the tumblers 82 are retracted. Thus, the lock cylinder 18 can be restored to a normal operating condition by rotating the lock cylinder 18 with the appropriate key fully inserted until such time as the cam projections 50 and the cam recesses 126 are again aligned, the sleeve 22 snaps axially toward the receiving end 38 of the housing 14 (under influence of the spring 174), and the clutch disk 26 snaps axially toward the receiving end 38 of the housing as the dogs 102*a*, 102*b* are one again received within the clutch recesses 150.

During normal operation of the embodiment illustrated in FIGS. 1–9, when the appropriate key is inserted into the lock cylinder 18, the sidebar 94 (and/or the tumblers 82 if so configured) retracts into the barrel portion 78 of the lock cylinder 18 such that the lock cylinder 18 and the sleeve 22 are no longer coupled for rotation together. It will be appreciated that for locks that do not include a sidebar (e.g. "tumbler locks"), the tumblers fully retract within the barrel portion 78 of the lock cylinder 18 to decouple the lock cylinder 18 from the sleeve 22.

When the lock cylinder 18 is subsequently rotated, the sleeve 22 remains substantially stationary with respect to the housing 14. As such, there is substantially no axial movement of the sleeve 22 or the clutch disk 26, and the clutch recesses 150 remain engaged with the lock cylinder dogs 102*a*, 102*b*. In addition, because the radial clutch disk protrusions 138 do not engage the pin 64, the clutch disk 26 is free to rotate with respect to the housing 14. Thus, as the lock cylinder 18 is rotated, the clutch disk 26 and the actuator element 30 are also rotated due to the engagement between the dogs 102*a*, 102*b* and the recesses 150 as well as the engagement between the clutch disk notches 142 and the actuator element projections 162. Rotation of the actuator element 30 through a sufficient angle results in operation of the device to which the actuator element is coupled (e.g., actuation of the device to a locked or unlocked state). Once the lock cylinder 18 has been sufficiently rotated, the torsional spring 178 (if employed) returns the lock cylinder 18 to its original angular orientation with respect to the housing 14. Regardless of whether the lock cylinder 18 is rotated with the appropriate key inserted or not, the lock cylinder 18 can remain substantially axially fixed with respect to the housing 14.

In addition to preventing forceful turning of the lock cylinder 18 by inserting an object into the key slot 90, the locking mechanism 10 also prevents substantial rotation of the actuator element 30 by grasping, pulling, or otherwise directly manipulating the actuator element 30. For example, if the locking mechanism 10 is installed in a vehicle door, attempts to overcome the lock may be made by inserting a thin piece of metal including a small hook (often referred to as a "slim-jim") between the outer door housing and the door glass. The hook is then engaged with the lock output tab 166 in an effort to move the lock output tab 166 sufficiently to unlock the vehicle door. If such an attempt to overcome the locking mechanism 10 is made, the lock output tab 166 will only be movable through the relatively small angle alpha such that unlocking of the door is substantially prevented. Specifically, as the actuator element 30 is rotated, the driving engagement between the projections 162 and the clutch protrusions 138 causes the clutch disk 26 to rotate with respect to the housing 14. Also, the driving engagement between the clutch recesses 150 and the dogs 102*a*, 102*b* impart rotation to the lock cylinder 18 which in turn imparts rotation to the sleeve 22 due to the engagement between the sidebar 94 (which remains extended) and the groove 130. As discussed above, rotation of the sleeve 22 with respect to the housing 14 causes the sleeve 22 and the clutch disk 26 to move axially toward the retaining end 54. Such axial movement of the clutch disk 26 causes one of the radial clutch disk protrusions 138 to engage the pin 64, thereby preventing further rotation of the clutch disk 26. Because the clutch disk 26 and the actuator element 30 are substantially always coupled for rotation together, preventing further rotation of the clutch disk 26 prevents further rotation of the actuator element 30. As such, once the actuator element 30 is rotated through the relatively small angle alpha, further rotation of the actuator element 30 (which would result in unlocking of the door) is substantially prevented.

FIGS. 10–18 illustrate a locking mechanism 210 according to another embodiment of the present invention. The locking mechanism 210 illustrated in FIGS. 10–18 and described below shares much in common with the locking mechanism 10 described above and illustrated in FIGS. 1–9. Accordingly, the description above regarding the various elements and features of the first illustrated embodiment (as well as the alternatives of such elements and features also described above) applies to corresponding elements and features in the second illustrated embodiment of FIGS. 10–18, with the exception of mutually inconsistent elements and features between these embodiments.

With reference first to FIGS. 10–13, the locking mechanism 210 includes an outer housing 214, a lock cylinder 218 received within the housing 214, a sleeve 222 also received with the housing 214 and surrounding at least a portion of the lock cylinder 218, and a pair of sleeve guides 224 positioned between the lock cylinder 218 and the sleeve 222. The locking mechanism 210 also includes an actuator element 230 that is adapted for connection to a cable for actuation thereof, and an endcap 231 that cooperates with the housing 214 to substantially encase the remaining lock components. It will be appreciated, however, that other types of actuator elements for actuating different types of mechanisms can be used as well.

The housing 214 provides a generally cylindrical, open-ended cavity 232 and defines a central axis 234. In this regard, the housing 214 can take any shape within which the lock cylinder 218 can be received, and in some embodiments (such as that shown in the figures) has a generally round cross-sectional shape. The housing 214 can enclose any amount of the lock cylinder 218 desired, such as by surrounding the length of the lock cylinder as shown in the figures.

The housing 214 can include outwardly extending mounting protrusions 236 that are securable to, among other things, a vehicle door or vehicle steering column that is to be lockably secured by the locking mechanism 210. The mounting protrusions 236 can take a variety of different forms and are generally determined by the device or mechanism (e.g. a vehicle part or assembly) to which the locking mechanism 210 is to be secured.

A cylinder-receiving end 238 of the housing 214 includes an internal lip 242 for limiting axial movement of the lock cylinder 218 and the sleeve guides 224 within the housing 214. In other embodiments, lock cylinder and sleeve guide travel can be limited in any other manner desired, and by different structural features. For example, one or more bosses, pins, neck portions, and other features of the housing 214 (as well as element attached to the housing 214), can limit the travel of one or both of the lock cylinder and the sleeve guides, each of which falls within the spirit and scope of the present invention.

For purposes that will be described in greater detail below, the housing 214 also includes a cam surface 246 extending radially into the cavity 232 and facing axially away from the receiving end 238. The cam surface 246 defines one or more axial cam recesses 250 within the cavity 232.

Opposite the cylinder-receiving end 238 of the housing 214 is a retaining end 254. The retaining end 254 of the housing 214 can be the same size as the cylinder-receiving 238 end or can have any other size desired, and in some embodiments (such as that illustrated in the figures) is somewhat diametrically enlarged with respect to the receiving end 238 of the housing 214. The retaining end 254 includes a radially outwardly extending circumferential lip 256 that is engageable with the endcap 231, and a radially outwardly positioned and axially extending return spring arm 258.

The lock cylinder 218 is received within the cavity 232 and can take any conventional lock cylinder form. By way of example, the lock cylinder 218 in the illustrated embodiment includes a barrel portion 278 that houses a plurality of lock tumblers 282. Other types of tumbler or pin-type lock cylinders can be employed in conjunction with the present invention as desired. Although the lock cylinder 218 can have any shape, the lock cylinder 218 illustrated in the figures includes an end flange 286 that seats against the internal lip 242 in the housing 214 when the lock cylinder 218 is inserted into the cavity 232. The internal lip 242 assists in properly positioning the lock cylinder 218 with respect to the housing 214, and can be replaced with any number of other elements and structure capable of performing the same function (including those described above with reference to the internal lip 42).

At one end of the lock cylinder 218 is a key slot 290 that receives a key (not shown). When an appropriate key is inserted into the lock cylinder 218, the lock tumblers 282 engage the key and move within the barrel portion 278 to predetermined positions such that the lock cylinder 218 is placed in an unlocked state. If no key or an incorrect key is inserted into the lock cylinder 218, one or more of the lock tumblers 282 will be improperly positioned, and the lock cylinder 218 will remain in a locked state.

In some embodiments of the present invention, when the lock cylinder 218 is in the locked state, one or more of the tumblers 282 extend radially outwardly from the barrel portion 278 to engage the sleeve guides 224, the housing 214, or another adjacent element or elements, and to thereby prevent rotation of the lock cylinder 218. When an appropriate key is inserted into the lock cylinder 218, the tumblers retract radially inwardly into the barrel portion 278 to a position corresponding to the unlocked state of the lock cylinder 218. In alternate embodiments of the present invention (such as those described above with respect to FIGS. 1–9), the lock cylinder 218 can also include a sidebar that functions and operates substantially the same as the sidebar 94 described above. The specific operation of and interaction between the key and the lock tumblers 282 (as well as between the lock tumblers 282 and the sidebar, where employed) are well known in the art and are therefore not discussed further herein. While one specific type of lock cylinder 218 is illustrated in the drawings, substantially any type of rotatable lock cylinder is suitable for use with the present invention.

The lock cylinder 218 in the illustrated embodiment also has an axially extending boss 298 (substantially aligned with the central axis 234 when the lock cylinder 218 is received within the cavity 232) that helps to maintain the position of the lock cylinder 218 in the locking mechanism 210. The boss 298 can have any shape desired, such as the generally cylindrical shape shown in the figures. With continued reference to the illustrated embodiment, one or more dogs 302 extend radially outwardly from the boss 298. The dogs 302 can have any shape desired suitable for establishing driving engagement with the actuator element 230 as will be described in greater detail below. In this regard, the lock cylinder 218 can have a single dog 302 or more than two dogs 302 for this purpose. The dogs 302 can be located in any position on the lock cylinder 218 facilitating releasable engagement with the actuator element 230, and in the illustrated embodiment extend in diametrically opposite positions from the axially extending boss 298.

In some embodiments of the present invention, the axially extending boss 298 includes a groove 300 extending fully or partially around its distal end for receiving a clip 370 or other fastener that retains the elements of the locking mechanism 210 in their proper relative positions. In other embodiments, the elements of the locking mechanism 210 can be retained in their proper relative positions in other ways, such as by tightening a nut on a threaded end of the axially extending boss 298, by any conventional fastener secured to the end of the axially extending boss 298, and the like.

Figure 12:
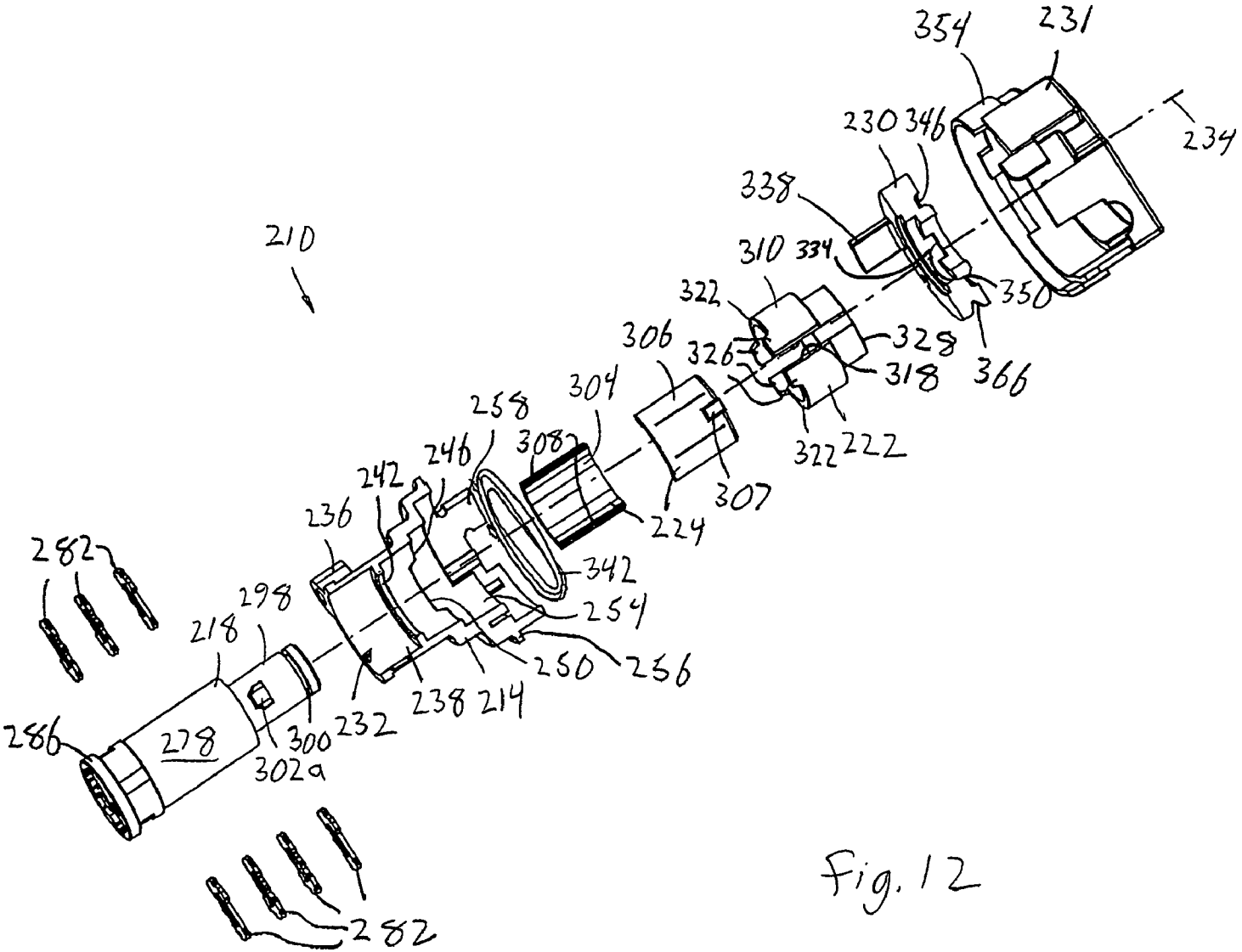
FIG. 12 is another exploded perspective view of the freewheeling lock mechanism of FIG. 10, shown partially sectioned.
Figure 13:
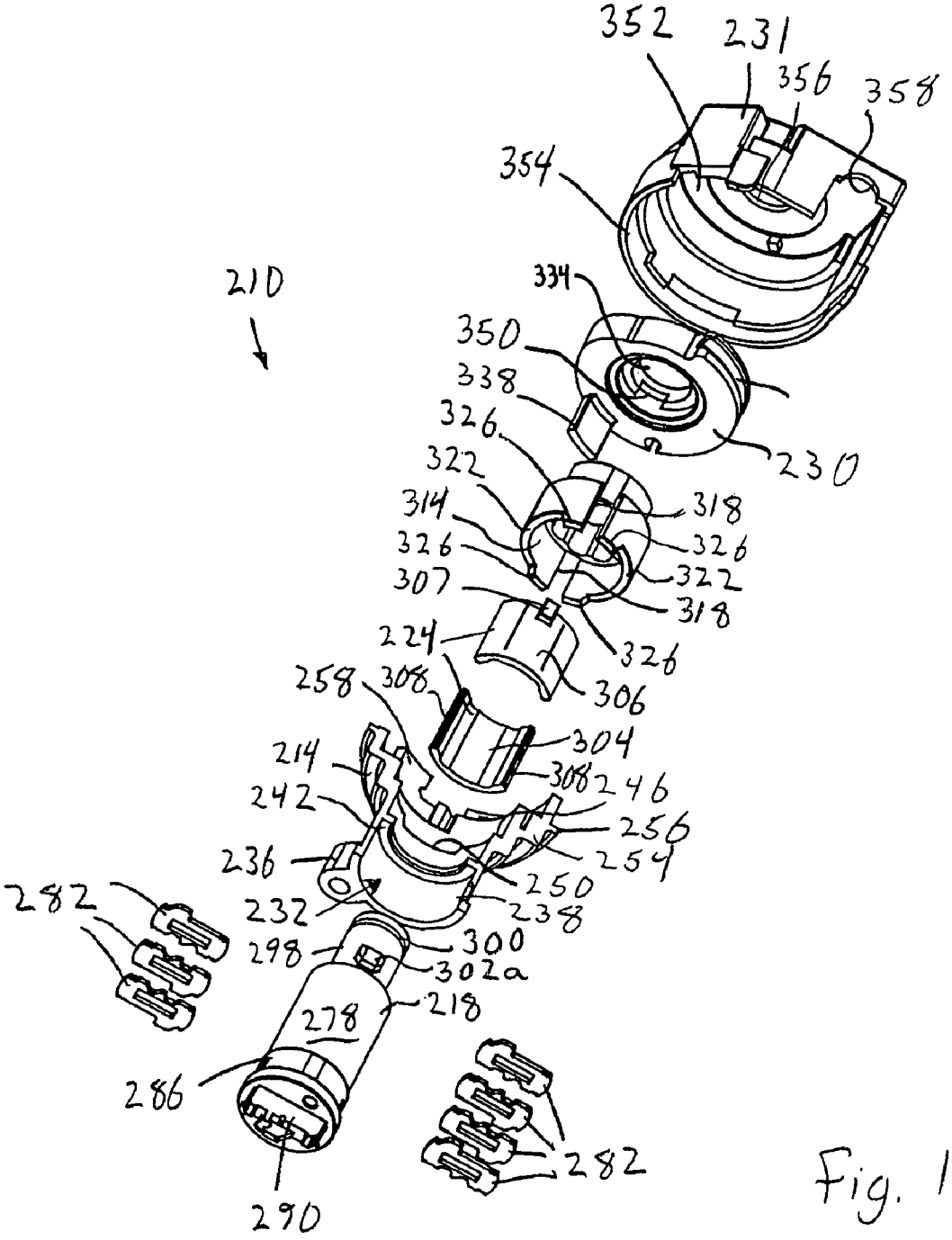
FIG. 13 is yet another exploded perspective view of the freewheeling lock mechanism of FIG. 10, shown partially sectioned.
Figure 14:
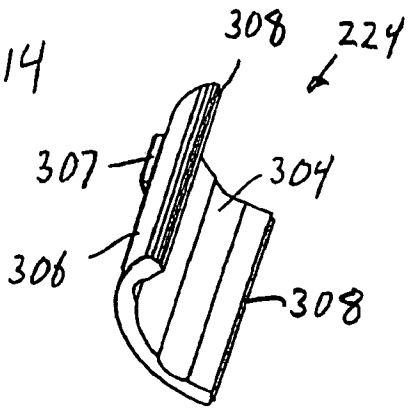
FIG. 14 is a perspective view of a sleeve guide of the freewheeling lock mechanism of FIG. 10.
Figure 15:
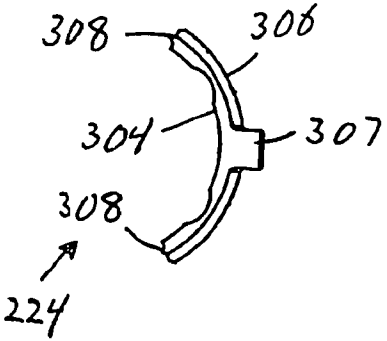
FIG. 15 is an end view of the sleeve guide of FIG. 14.

The sleeve guides 224 in the illustrated embodiment of FIGS. 10–18 are substantially identical. Accordingly, only one of the illustrated sleeve guides 224 will be described below. However, it should be noted that a single sleeve guide 224, or three or more sleeve guides 224 can instead be used. Furthermore, when a plurality of sleeve guides 224 are used, the sleeve guides 224 need not necessarily be identical to one another. Each sleeve guide 224 is contoured to lie adjacent a portion of the barrel portion 278. With reference to FIGS. 14 and 15, each illustrated sleeve guide 224 has an arcuate cross-sectional shape and includes an inner surface 304 that faces the barrel portion 278 between the diametrically opposed lock tumblers 282. Each sleeve guide also has an outer surface 306 having a radial projection 307 extending radially away therefrom. In the illustrated embodiment, the radial projection 307 is generally rectangular. However, the radial projection 307 can have any other shape desired. Furthermore, more than one projection can be provided on each sleeve guide 224, if desired.

Each sleeve guide 224 in the exemplary illustrated embodiment also includes two radially and axially extending bearing surfaces 308 extending between the inner and outer surfaces 304, 306. In the illustrated exemplary embodiment, the two sleeve guides 224 are positioned diametrically opposite one another and closely surround the barrel portion 278. When the lock cylinder 218 is in the locked state, the tumblers 282 extend radially from the barrel portion 278 and between the bearing surfaces 308 of the two sleeve guides 224. If the lock cylinder 218 is rotated with respect to the housing 210 while in the locked configuration, at least one of the tumblers 282 contacts at least one of the bearing surfaces 308 such that the sleeve guides 224 are substantially rotatably fixed with respect to the lock cylinder 218, or otherwise limit the amount of rotation of the lock cylinder 218 with respect to the sleeve guides 224.

In some embodiments, the pressure that may be applied to the bearing surfaces 308 by forced rotation of the lock cylinder 218 in the locked state (e.g., when forced by a thief or other unauthorized person) can be sufficient to cause one or more of the tumblers 282 to "bite into" either or both sleeve guides 224. In this regard, the sleeve guides 224 can therefore be at least partially axially fixed with respect to the tumblers 282 when the lock cylinder 218 is forced to rotate in the locked state.

In those embodiments of the preset invention employing a sidebar as described above, the sleeve guides 224 can also include or can cooperate to define an aperture or recess configured to receive the sidebar. The aperture or recess for the sidebar can have any shape and location suitable for receiving the sidebar. In some embodiments, the aperture or recess is an axially extending groove that is recessed within or with respect to the inner surface 304 of the sleeve guide 224 for receiving the sidebar when the sidebar is extended (axially away from the lock cylinder 218). In some embodiments of the present invention, the engagement between the sidebar and the aperture or recess alleviates the need for engagement between the tumblers 282 and the bearing surfaces 309. In this respect, some embodiments of the present invention can include tumblers 282 that do not extend from the lock cylinder 218 regardless of the condition (e.g. locked or unlocked) of the lock cylinder 218.

Figure 16:
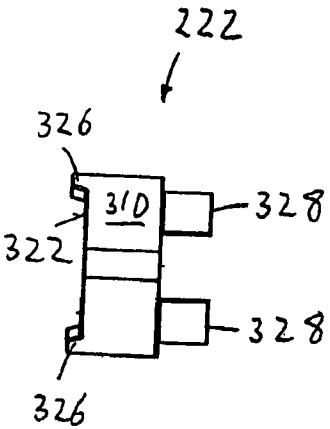
FIG. 16 is a side view of a sleeve of the freewheeling lock mechanism of FIG. 10.
Figure 17:
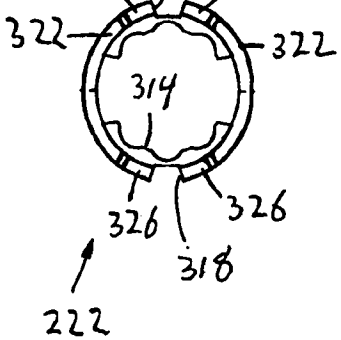
FIG. 17 is an end view of the sleeve of FIG. 16.

Referring now to FIGS. 16 and 17, the sleeve 222 in the illustrated exemplary embodiment is generally tubular and is received within the annular space formed between the housing 214 and the sleeve guides 224 when the lock cylinder 218 and sleeve guides 224 are inserted into the cavity 232. An outer surface 310 of the sleeve 222 faces the housing 214, and an inner surface 314 of the sleeve 222 faces the outer surfaces 306 of the sleeve guides 224. In some embodiments (such as the illustrated exemplary embodiment of FIGS. 10–18), the sleeve 222 has at least one aperture or recess 318 within which the radial projections 307 of the sleeve guides 224 can be received, or has at least one bearing surface against which the radial projections 307 of either or both sleeve guides 224 can push when the sleeve guides 224 are rotated about the axis of the lock cylinder 218 (as will be described in greater detail below) in either or both directions.

By way of example only, in those embodiments of the present invention having one sleeve guide 324, the sleeve 222 can have a single aperture or recess 318. As another example, the sleeve 222 can have multiple apertures or recesses 318, such as where two or more sleeve guides 224 are utilized. In the illustrated exemplary embodiment, the sleeve 222 has two diametrically opposed elongated slots 318 positioned to receive the radial projections 307 from the pair of diametrically opposed sleeve guides 224.

When the tumblers 282 extend between the impact surfaces 308 of the sleeve guides 224 in the illustrated embodiment of FIGS. 11–18, the sleeve guides 224 are coupled for rotation with the lock cylinder 218 as discussed above, and the sleeve 222 is coupled for rotation with the sleeve guides 224 due to engagement between the radial projections 307 and the elongated slots 318. Thus, when the lock cylinder 218 is rotated in the locked configuration, the sleeve 222 rotates with the lock cylinder 218 but remains axially slidable with respect to the lock cylinder 218. A similar relationship exists in cases where the tumblers 282 (or sidebar, in some embodiments) are extended to position(s) in which the rotation of the lock cylinder 218 causes the tumblers 282 (or sidebar) to abut one or more sleeve guides 224 having different shapes and sizes as described herein.

One end of the sleeve 222 includes at least one cam surface 322 that engages the cam surface 246 of the housing 214. The cam surface 322 provides one or more axial cam projections 326 that are configured to engage the one or more cam recesses 250 of the housing 214. The other end of the sleeve 222 includes at least one clutch surface 328 that engages the actuator element 230 in the locked state of the lock cylinder 218. As will be described further below, the "clutch" portion of the illustrated lock mechanism is provided by the sleeve 222 and the actuator element 230.

With continued reference to the illustrated embodiment of the present invention, the length of the sleeve 222 is selected such that when the end flange 286 of the lock cylinder 218 is engaged with the internal lip 242 of the housing 214, and the cam projections 326 are aligned with and received by the cam recesses 250, the dogs 302*a*, 302*b* of the lock cylinder 218 extend axially beyond the clutch surface 328 toward the actuator element 230.

Figure 11:
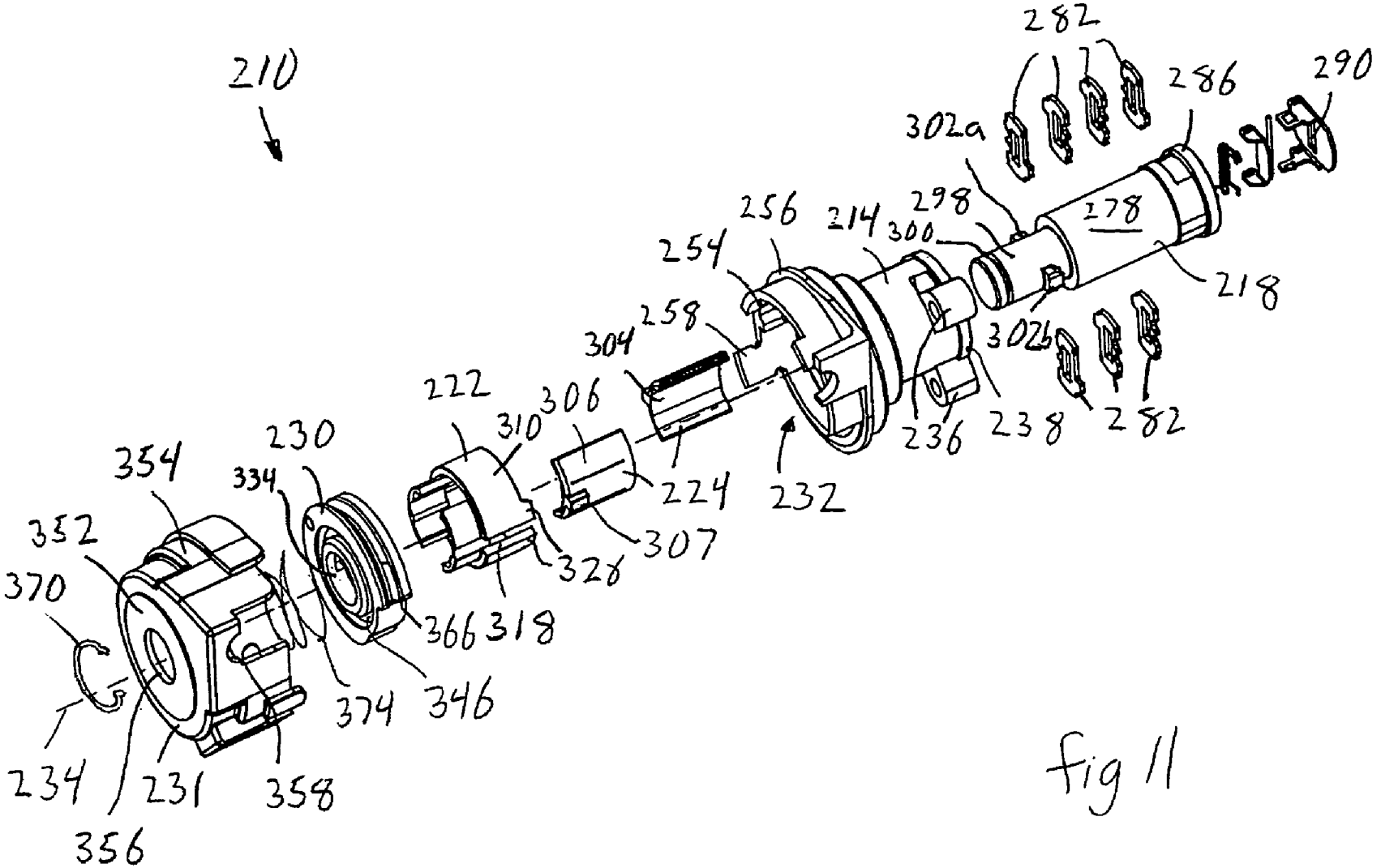
FIG. 11 is an exploded perspective view of the freewheeling lock mechanism of FIG. 10.

The actuator element 230 can have any shape desired, dependent at least partially upon the shape and position of the boss 298 and the sleeve 222. With continued reference to FIGS. 11–13 for example, the actuator element 230 is generally round, is received by the retaining end 254 of the housing 214, and includes a central aperture 334 that receives the boss 298 of the lock cylinder 218. The actuator element 230 can include one or more axially extending projections 338 (e.g., at a radially outer position as shown in FIGS. 11–13 or in any other location on the actuator element 230) providing an engagement surface for a lock return spring 342.

In some embodiments, one side of the actuator element 230 includes a substantially annular recess 346 that surrounds the central aperture 334 and/or one or more recesses 350 extending radially outwardly from the central aperture 334 on the other side of the actuator element 230. In the illustrated embodiment of FIGS. 11–18 for example, the actuator element 230 includes two recesses 350 that are substantially diametrically opposed to each other (although other numbers and arrangements of such recesses 350 are possible depending at least in part upon the number and arrangement of the dogs 302*a*, 302*b* on the lock cylinder 218). The recesses 350 are adapted and configured to at least partially receive the dogs 302*a*, 302*b* of the lock cylinder 218, such that rotational movement of the lock cylinder 218 is transmitted to the actuator element 230 due to driving engagement between the dogs 302*a*, 302*b*, and the recesses 350. Such driving engagement can be produced in other manners, each one of which falls within the spirit and scope of the present invention. By way of example only, driving engagement can be provided by one or more internal walls, bosses, or other stops on the inside of the actuator element positioned to abut the dogs 302*a*, 302*b* upon rotation of the lock cylinder 218 in the unlocked state.

The endcap 231 in the illustrated embodiment of FIGS. 11–18 includes an end wall 352 and sidewalls 354 extending from the end wall 352. The end wall 352 defines a central aperture 356 through which the boss 298 extends. The sidewalls 354 extend away from the endwall 352 and can engage the housing 214 to at least partially encase the lock cylinder 218, the sleeve 222, the sleeve guides 224, and the actuator element 230. Other endcap shapes are possible without departing from the present invention. In the illustrated embodiment, one of the sidewalls 354 defines an opening 358 through which a coupling member in the form of a bowden cable 360 (see FIG. 10) extends.

The lock mechanism 210 can be connected to a latch or other mechanism to be locked by a number of different elements and structure on the lock mechanism 210. By way of example only, the lock mechanism 210 in the illustrated embodiment has a circumferentially extending cable guiding groove 366 defined in the actuator element 230. The groove 366 is configured for connection with the bowden cable 360, which extends through the opening 358 and is in turn coupled to a latch, switch, or substantially any other mechanism or device that is to be controlled and/or locked by the lock mechanism 210. In alternative embodiments, the actuator element 230 can have an actuator shaft or other member extending axially from the actuator element 230 and coupled to a vehicle ignition, door latch, or other mechanism for locking and unlocking the mechanism by rotation of the actuator shaft. In still other embodiments, the actuator element 230 can have one or more tabs, apertures, bosses, flanges, fingers, arms, or other connecting points to which one or more cables, rods, levers, or other elements can be connected for transmitting motion from the locking mechanism 210 to a device connected thereto. In this regard, the opening 358 in the endcap 231 (if employed) can have a variety of different shapes, sizes, and configurations depending at least in part upon the feature or features provided on the actuator element 230.

The above-described cable guiding groove 366, axially extending shaft, and alternative connecting points of the actuator element 230 are only a small number of examples of lock output mechanisms. Many elements and mechanisms for transmitting rotational movement of the lock mechanism 210 to rotational, translational, and other types of movement for actuation of various devices (e.g. door latches and vehicle ignitions) are well known to those skilled in the art. Each of these actuating elements and devices can be used in combination with the teachings of the present invention and fall within the spirit and scope of the present invention. The use of the locking mechanism 210 in a vehicle and/or for locking and unlocking a door latch is merely exemplary. Many other uses and applications for the locking mechanism 210 according to the present invention would be contemplated by those of skill in the art.

As mentioned above, the end of the boss 298 extending away from the barrel portion 278 of the lock cylinder 218 has a circumferential groove 300 for receiving a retaining element 370 (see FIG. 11). In this regard, when the locking mechanism 210 illustrated in the figures is assembled (see FIG. 10), a portion of the lock cylinder boss 298 extends beyond the end wall 352 of the endcap 231 such that the circumferential groove 300 in the end of the boss 298 is exposed.

The retaining element 370 (e.g., a C or E-clip, a retaining ring, or the like) can be positioned in the circumferential groove 300 to secure the components of the locking mechanism 210 within the housing 214. In other embodiments of the present invention, the boss 298 (or at least the end thereof) can be threaded or otherwise shaped so that a nut or other conventional fastener can be used in place of or in addition to the retaining element 370. In still other embodiments, the actuator element 230 and/or the endcap 231 is retained in place with respect to the housing 214 and the other elements of the locking mechanism 210 by one or more inter-engaging lips, grooves, pins, or other fastening elements or features (e.g., a circumferential groove in the housing 214 within which a flange, lip, rib, or other circumferential protrusion of the actuator element 230 extends, or vice versa, and the like). Still other manners of connection between the actuator element 230 and the lock cylinder 218 are possible, each permitting relative rotation between the actuator element 230 and the housing 214 and each falling within the spirit and scope of the present invention.

In some embodiments of the present invention such as that shown in the figures, it is desirable to bias the actuator element 230 toward the sleeve 222. A number of different spring elements in a number of different locations can be employed for this purpose. In the illustrated embodiment for example, the locking mechanism 210 includes a biasing element in the form of a helical compression spring 374 located between the actuator element 230 and the endcap 231.

In other embodiments, other types of spring elements can be employed, such as leaf springs, resilient bushings, Belleville washers, and the like. The spring 374 in the illustrated embodiment is received by the annular recess 346, although the recess 346 is not required to bias the clutch disk 226 as described above. The spring 374 is compressed between the actuator element 230, and the endcap 231 such that a biasing force is applied to the actuator element 230, thereby biasing the recesses 334 into engagement with the lock cylinder dogs 302*a*, 302*b*.

In some embodiments, a biasing element is provided to bias the lock cylinder 218 and/or the actuator element 230 toward a predetermined angular orientation with respect to the housing 214. In the illustrated embodiment, the lock return spring 342 engages the return spring arm 258 on the housing 214 and the projection 338 of the actuator element 230 in such a way that the actuator element 230 is biased in a rotational direction with respect to the housing 214. The biasing force acts against rotation of the actuator element 230 and urges the actuator element 230 back toward its original angular position after being rotated away from such a position (e.g., by rotation of the lock cylinder 218 engaged with the actuator element 230). One having ordinary skill in the art will appreciate that other types of springs and spring elements can be employed to urge the actuator element 230 and/or lock cylinder 218 to an unactuated position with respect to the housing 214, and that such springs and spring elements can be connected to provide this biasing force in a number of different manners, each one of which falls within the spirit and scope of the present invention. For example, some embodiments of the invention can include a single spring that functions as the compression spring 374 and the lock return spring 342.

If the lock cylinder 218 is rotated with the proper key inserted, the lock cylinder 218 and actuator element 230 will rotate together through an angle that is sufficient to effectively actuate the device to which the actuator element 230 is coupled (e.g. a door latch, a vehicle ignition switch, and the like). As will be described in greater detail below, if the lock cylinder 218 is rotated without the proper key inserted, the sleeve 222 and the actuator element 230 move axially such that the recesses 350 in the actuator element 230 disengage from the dogs 302*a*, 302*b* on the lock cylinder 218. The lock cylinder 218, the sleeve guides 224, and the sleeve 222 are then able to rotate freely, while rotation of the actuator element 230 is precluded or sufficiently limited due to the biasing force provided by the lock return spring 342. Alternatively, rotation of the actuator element 230 can be precluded or sufficiently limited as just described by interference between one or more stops, fingers, or other projections on the actuator element and on the endcap 231 or housing 214 when the actuator element 230 is moved by the sleeve 222 as will be described in greater detail below.

Given the arrangement and configuration of the various components described above, the locking mechanism 210 provides free rotation of the lock cylinder 218 within the housing 214 when an attempt to rotate the lock cylinder 218 is made using substantially any item other than the appropriate key (e.g. the wrong key, a screwdriver, or the like). As used herein, "free rotation" of the lock cylinder 218 means that rotation of the lock cylinder 218 does not impart significant rotational movement to the actuator element 230 or otherwise imparts insufficient rotational movement to the actuator element 230 to fully actuate the device connected to the locking mechanism 210. By preventing rotational movement of the actuator element 230 or by restricting the amount of rotational movement transmitted from the lock cylinder 218 to the actuator element 230 to a relatively small amount, operation of the device or mechanism to which the actuator element 230 is coupled is precluded. Of course, if the appropriate key is inserted into the lock cylinder 218, rotation of the lock cylinder 218 results in less restricted rotation (and in some embodiments, unrestricted rotation) of the actuator element 230. Accordingly, by using the appropriate key, the locking mechanism 210 is fully operational to lock/unlock or activate/deactivate the associated device or mechanism to which the actuator element 230 is coupled.

When substantially any item other than the appropriate key is used to rotate the lock cylinder 218 of the illustrated exemplary embodiment, the lock cylinder 218 remains in the locked condition such that the lock tumblers 282 remain extended from the barrel portion 278 and extend between the impact surfaces 308 of the sleeve guides 224. As such, the lock cylinder 218, the sleeve guides 224, and the sleeve 222 are substantially rotatably fixed to each other. In alternative embodiments, the tumblers 282 may also or alternatively extend from the lock cylinder 218 and project into the apertures or slots 318 in the sleeve 222 to rotatably fix the lock cylinder 218 to the sleeve 222, may extend to positions beside an edge or face of one or more sleeve guides (having any shape capable of transmitting the rotational force from the tumblers 282 to the sleeve 222 as described herein). In response to coupled rotation of the lock cylinder 218, the sleeve guides 224, and the sleeve 222, the cam recesses 250 and the cam projections 326 in the illustrated exemplary embodiment of FIGS. 10–18 engage each other and urge the sleeve 222 axially toward the actuator element 230.

As the sleeve 222 moves axially along the housing 214, the clutch surface 328 of the sleeve 222 engages the actuator element 230 (if not already in contact with the actuator element 230) and urges the actuator element 230 in an axial direction against the biasing force of the compression spring 374. As the actuator element 230 moves axially in this manner, the recesses 350 in the actuator element 230 become disengaged from the dogs 302*a*, 302*b* on the lock cylinder 218. Once disengaged, the lock cylinder 218 and the actuator element 230 are no longer drivingly coupled for rotation together, and the clutch surface 328 slides with respect to the actuator element 230.

As the sleeve 222 in the illustrated exemplary embodiment of FIGS. 10–18 continues to rotate, rotation of the actuator element 230 is precluded or sufficiently limited by the biasing force provided by the lock return spring 342. In those cases where the actuator element 230 is still capable of slight rotational movement (e.g., under biasing force of the lock return spring 342) when being disengaged or when disengaged from the lock cylinder 218 as described above, the locking mechanism 210 and the device to which the mechanism 210 is attached are configured such that any relatively small amount of actuator element rotation does not fully operate, actuate, or otherwise influence the state (e.g., locked or unlocked) of the device.

In the illustrated embodiment of FIGS. 10–18, the locking mechanism 210 has two cam projections 326 and two cam recesses 250. Once the lock cylinder 218 and sleeve 222 of this locking mechanism 210 have been rotated approximately 180 degrees, the cam projections 326 and cam recesses 250 are once again aligned (albeit with engagement between opposite cam projections 326 and cam recesses 250) and the biasing force of the compression spring 374 urges the actuator element 230 and the sleeve 222 axially toward the cylinder-receiving end 238 of the housing 214, thereby re-engaging the cam projections 326 with the cam recesses 250, and the clutch recesses 350 in the actuator element 230 with the lock cylinder dogs 302*a*, 302*b* of the lock cylinder 218. Still further rotation of the lock cylinder 218 in a forceful manner (e.g. with the lock cylinder 218 in the locked condition) repeats the above-described disengagement/re-engagement cycle. Accordingly, the lock cylinder 218 can by continuously rotated by an improper key or other object without imparting significant forces upon the actuator element 230 or the lock tumblers 282, thereby preventing alteration of or damage to the locking mechanism 210 and preventing operation or actuation of the device connected thereto. In the illustrated exemplary embodiment of FIGS. 10–18 the lock cylinder 218 remains substantially axially fixed with respect to the housing 214 regardless of whether the lock cylinder 218 is rotated in the locked or unlocked condition.

In other embodiments of the present invention in which the same, fewer, or more sleeve guides 224 are provided in any arrangement about the axis 234 of the locking mechanism 210, the lock cylinder 218 can be rotated different amounts before being re-engaged with the housing 214 in a manner similar to that described above. For example, in embodiments having a single set of tumblers 282 and a single sleeve guide 224, the lock cylinder 218 can be rotated approximately 360 degrees before becoming re-engaged with the sleeve 222. Still other angular amounts are possible without departing from the present invention.

When the appropriate key is inserted into the lock cylinder 218 of the illustrated exemplary embodiment in FIGS. 10–18, the tumblers 282 (and/or a sidebar if so configured) retract into the barrel portion 278 of the lock cylinder 218 such that the lock cylinder 218 and the sleeve 222 are no longer coupled for rotation together. When the lock cylinder 218 is subsequently rotated, the sleeve 222 remains substantially stationary with respect to the housing 214. As such, there is substantially no axial movement of the sleeve 222 or the actuator element 230, and the clutch recesses 350 of the actuator element 230 remain engaged with the lock cylinder dogs 302*a*, 302*b* of the lock cylinder 218. Therefore, as the lock cylinder 218 is rotated, the actuator element 230 is also rotated. Rotation of the actuator element 230 through a sufficient angle results in operation of the device to which the actuator element 230 is coupled (e.g., actuation of the device to a locked or unlocked state). After such rotation, the lock return spring 342 returns the lock cylinder 218 to its original angular orientation with respect to the housing 214. In the illustrated exemplary embodiment of FIGS. 10–18, as the lock cylinder 218 is rotated with the appropriate key inserted, the lock cylinder 218 remains substantially axially fixed with respect to the housing 214.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

For example, a number of alternatives exist to the use of a pin 64 and housing through-hole 62 for limiting rotation of the clutch disk 26 and/or the actuator element 30 in the exemplary embodiment of the present invention illustrated in FIGS. 1–9. In some embodiments, the housing 14 can be provided with one or more internal projections, fingers, bosses, or other features that are integral with the housing 14 or are otherwise secured to the housing 14 and that perform the same or similar functions as the pin 64.

Furthermore, the housing 14 illustrated in FIGS. 1–9 can be constructed of two or more elements or portions, such as a receiving end 38 and a retaining end 54 connected together in any conventional manner. Such a two-piece-housing 14 can be configured to receive a pin as described above, can include integrally formed radially inwardly extending projections on one or both of the ends 38, 54, can include other types of projections (e.g. axial projections formed on the retaining end 54) that engage the clutch disk 26 and/or the actuator element 30 upon axial movement of the clutch disk 26 to prevent rotation thereof, and the like.

Figure 18:
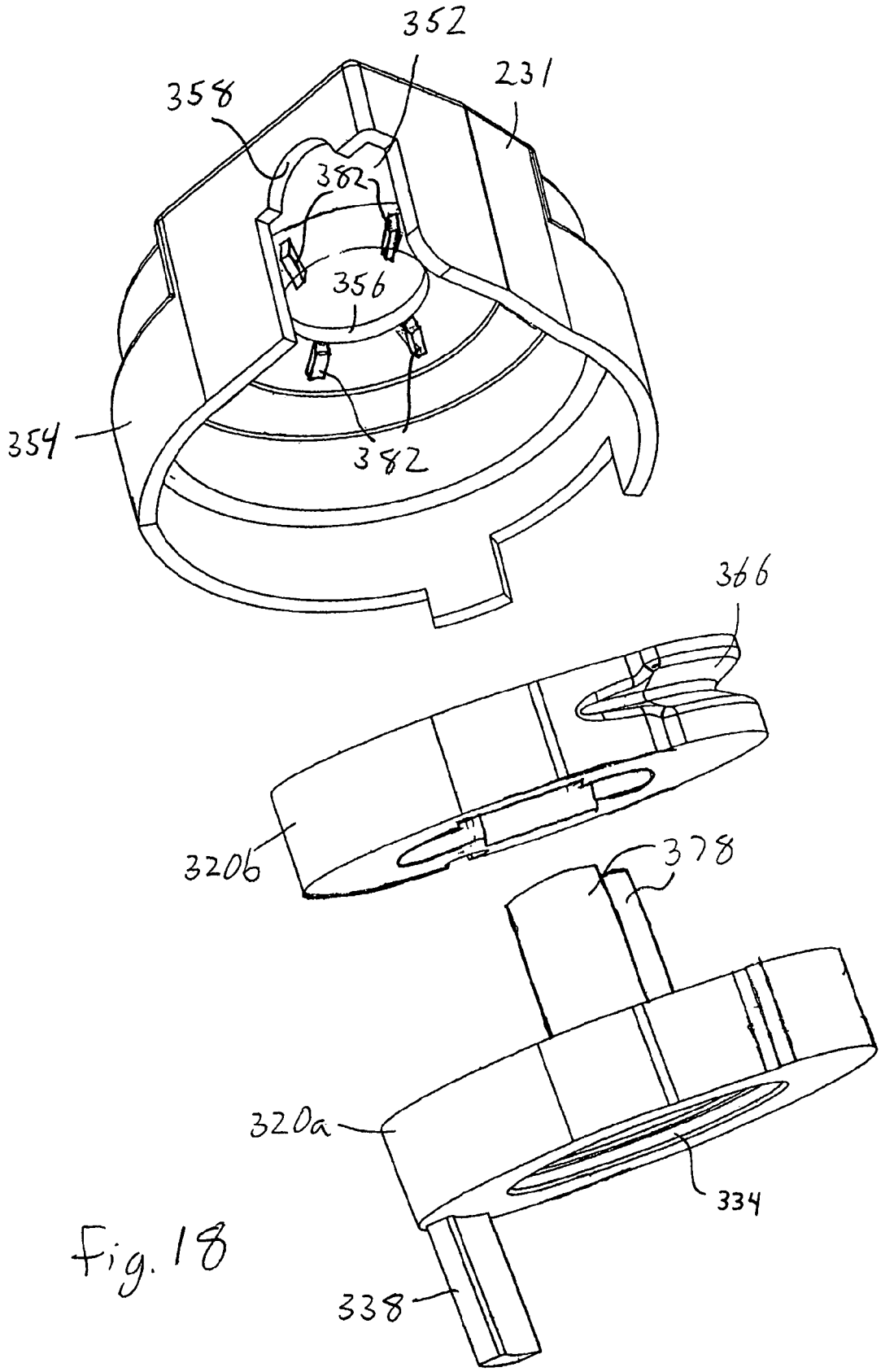
FIG. 18 is a perspective view of a portion of the freewheeling lock mechanism of FIG. 10.

A number of alternatives exist to the use of the lock return spring 342 to limit the movement of the actuator element 230 in the exemplary embodiment illustrated in FIGS. 11–18. With reference to FIG. 18 by way of example only, the actuator element 320 can be formed into two or more pieces, defining a first actuator element portion 320*a* having the projection 338 and the recesses 350, and a second actuator element portion 320*b* non-rotatably coupled to the first portion 320*a* and having the cable guiding groove 366. In some embodiments, including that illustrated in FIG. 18, the first portion 320*a* can be provided with one or more axially extending projections 378 received by the second portion 320*b* and that selectively engage an arrangement of tabs 382 and/or recesses defined in the endwall 352 of the endcap 231.

When the first actuator element portion 320*a* is moved axially in response to axial movement of the sleeve 222 due to rotation of the lock cylinder 218 in the locked condition as described above, the projections 378 engage or are otherwise received by or between the tabs 382 or recesses. Engagement of the projections 378 with the tabs 382 precludes or sufficiently restricts rotation of the first and second actuator element portions 320*a*, 320*b*. In the embodiment illustrated in FIG. 18, the second actuator element 320*b* may or may not move axially with the first actuator element portion 320*a* depending upon the specific application. It will also be appreciated that the endcap 231 and the housing 214 can be provided with substantially any other arrangement including projections, fingers, bosses, or other features that are integral with the housing 214 or the endcap 231 or are otherwise secured to the housing 214 or the endcap in any conventional manner, and that preclude or limit rotation of the actuator element 230 or actuator element portions 230*a*, 230*b*, if employed, as described above. In addition, it should be noted that the rotation-limiting engagement between the actuator element 230 just described can be provided regardless of whether the actuator element 230 is defined by a single element or is defined by two or more elements as shown in FIG. 18.

As another example of possible alternative locking mechanism configurations falling within the spirit and scope of the present invention, the housing 214 can be constructed of two or more elements or portions, such as a receiving end 238 and a retaining end 254 connected together in any conventional manner. Such a two-piece housing 214 can be configured substantially as described above and can include radially inwardly extending projections on one or both of the ends 238, 254, can include other types of projections (e.g. axial projections formed on the retaining end 254) that engage the actuator element 230 upon axial movement of the actuator element 230 to prevent rotation thereof, and the like.

The dogs 302*a*, 302*b* in the illustrated exemplary embodiment of FIGS. 10–18 are located adjacent an end of the barrel portion 278 of the lock cylinder 218, and are spaced on opposite sides of the boss 298 extending from the barrel portion 278. It should be noted, however, that other elements and features of the lock cylinder 218 could be employed to selectively drivably engage the actuator element 230 as described above. The generally bar-shaped dogs 302*a*, 302*b* illustrated in FIGS. 11–13 can be replaced by one or more elements having any shape that mates with one or more recesses in the clutch plate 226 or that otherwise rotatably engage the clutch plate 226 in any other manner. By way of example only, the bar-shaped dogs 302*a*, 302*b* can be replaced by one or more pins axially extending from the barrel portion 278 of the lock cylinder 218 into apertures in the actuator element 230, one or more flanges or ribs that extend radially from the actuator element 230 and that can be received within axially-extending recesses, grooves, or other apertures in the end of the barrel portion 278 of the lock cylinder 218, and the like. As another example, the locations of the dogs 302*a*, 302*b* and the recesses 350 can be reversed from those shown in the figures while still performing the same functions described herein. Any other engaging or mating elements on the lock cylinder 218 and actuator element 230 can be employed for enabling the lock cylinder 218 to be releasably engaged with the actuator element 230 for selectively transmitting rotational force from the lock cylinder 218 to the actuator element 230.

Although the dogs 302*a*, 302*b* or other engagement elements of the lock cylinder 218 can have the same or similar shape as the recesses 350 in the actuator element 230, such correspondence is not required to practice the present invention. In other embodiments, the lock cylinder 218 and actuator element 230 have sufficient frictional engagement between one another that additional features or elements intended for transmitting rotational force to the actuator element 230 are not necessary. It should also be noted that element(s) on the lock cylinder 218 for transmitting rotary force to the actuator element 230 need not necessarily be located as shown in FIGS. 11–13, but can instead extend from or otherwise be located in other positions on the lock cylinder 218.

As discussed above, one or more sleeve guides 224 are employed to provide one or more surfaces (e.g., bearing surfaces 308 in the embodiment illustrated in FIGS. 10–18) against which the tumblers 282 of the locking mechanism 210 can abut while also enabling the sleeve 222 to move axially in response to forced rotation of the lock cylinder 218 in its locked state. The sleeve guide(s) 224 can take any shape and size capable of performing these functions. By way of example only, the sleeve guides 224 can be elongated bars, blocks, pins, plates, or any other elements shaped to be engaged by the tumblers and to provide relative movement between the sleeve guides 224 and the sleeve 222. Yet another sleeve guide shape is provided in FIG. 19 by way of example only.

Figure 19:
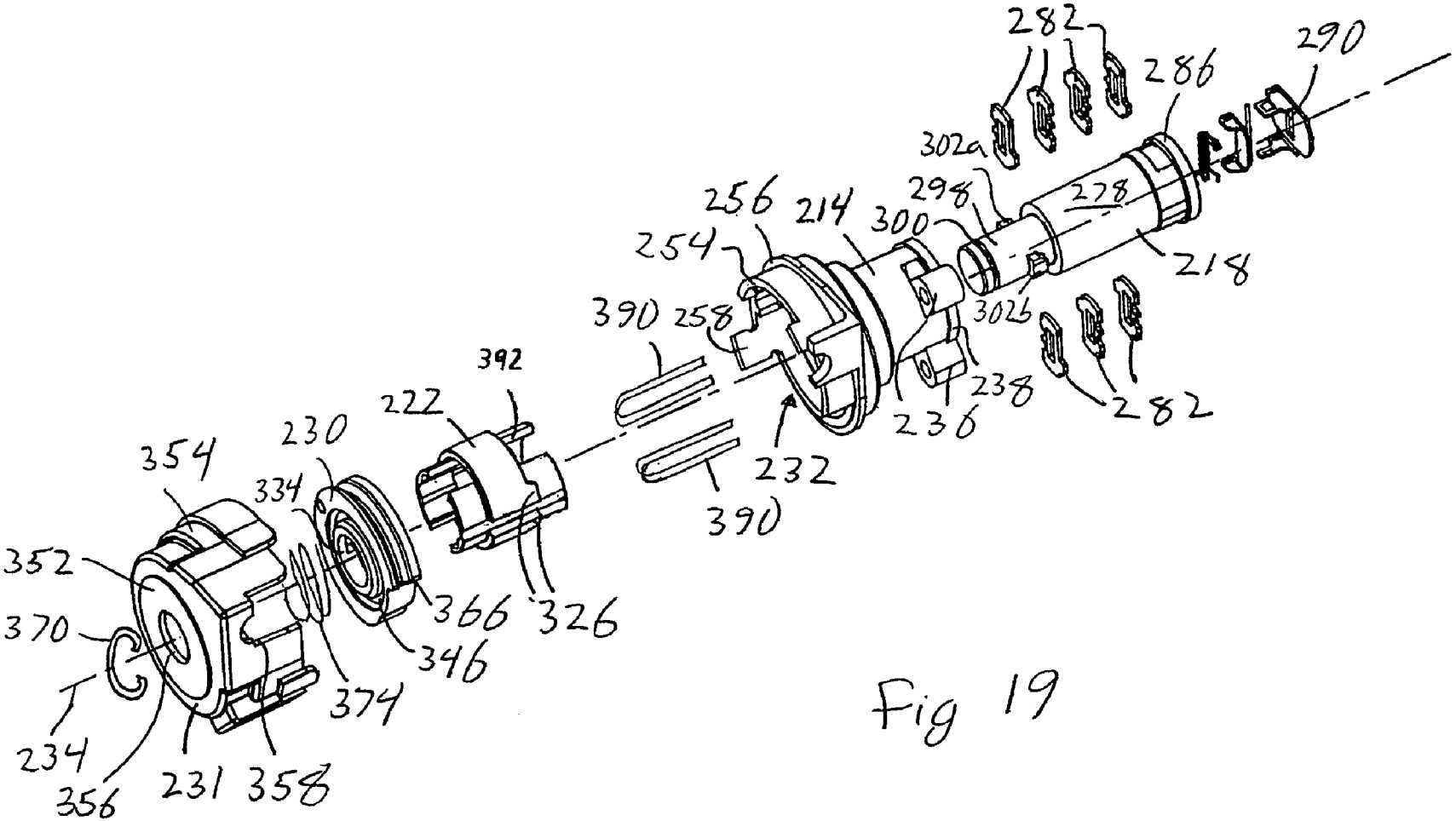
FIG. 19 is a perspective view of the freewheeling lock of FIG. 10 including an alternative configuration for the sleeve and sleeve guides.

In particular, FIG. 19 illustrates a locking mechanism 210 similar in construction and operation to that shown in FIGS. 10–18, with the exception of different sleeve guides being employed. Accordingly, the description above regarding the various elements and features of the first and second illustrated embodiments (as well as the alternatives of such elements and features also described above) applies to corresponding elements and features in the illustrated embodiment of FIG. 19, with the exception of mutually inconsistent elements and features between these embodiments.

In the embodiment of FIG. 19, the sleeve guides 390 are generally U-shaped, and perform the same general functions as the sleeve guides 224 in the embodiment illustrated in FIGS. 10–18. These sleeve guides 390 are positioned to extend between surfaces 392 of the sleeve 222 and the tumblers 282 when the tumblers 282 extend from the lock cylinder 218.

The sleeve guides 390 are constructed of a relatively hard material, such as spring steel. However, any other material can instead be employed, such as polymeric material and other types of metals. When the lock cylinder 218 is rotated in the locked configuration, the tumblers 282 engage the sleeve guides 390 and are therefore substantially prevented from biting into the bearing surfaces sleeve 222 and prohibiting axial movement of the sleeve 222. In the illustrated construction, the sleeve guides 390 move axially with the sleeve 222 in response to rotation of the lock cylinder 218 in the locked configuration, such that the sleeve guides 390 can slide with respect to the sleeve 222. It will be appreciated that the sleeve guides 390 could also remain stationary with respect to the sleeve 222 such that the tumblers 282 slide with respect to the sleeve guides 390. Of course, if the proper key is inserted, the lock tumblers 282 retract into the lock cylinder 218 and the lock cylinder 218 is free to rotate in the unlocked configuration as discussed above.

Although two impact members 390 are employed in the exemplary embodiment illustrated in FIG. 19, it will be appreciated that more or fewer sleeve guides 390 can be employed depending at least partially upon the configuration of the lock cylinder 218 as well as the configuration of the sleeve 222 and sleeve guides 390. Furthermore, the sleeve guides 390 need not necessarily be U-shaped as illustrated. For example, the sleeve guides 390 could be comprised of a pair of individual strips, wherein each strip is positioned to extend between surfaces of the sleeve 222 and a side of a respective set of tumblers 282. Various other configurations can also be utilized, and fall within the spirit and scope of the present invention.

With continued reference to the exemplary embodiment illustrated in FIG. 19, the shape of the sleeve 222 generally resembles the shape of the sleeve 222 and sleeve guide 224 in the embodiment illustrated in FIGS. 10–19. In particular, the sleeve 222 in the embodiment of FIG. 19 is a one-piece unit as shown, employs the cam projections 326 and recesses 318 as described above with reference to FIGS. 10–18, and has surfaces 392 similar to bearing surfaces 308 in FIGS. 10–18 (but that instead function to abut the sleeve guides 390 as discussed above). Although the sleeve 222 illustrated in FIG. 19 can take the shape shown, the sleeve 222 can take any other shape suitable for receiving rotational force from the sleeve guides 390 and moving axially in response to such force. In this regard, the sleeve 222 can employ one or more axially elongated abutment surfaces 392 against which the sleeve guides 390 can slide as described above.

It will be appreciated by one having ordinary skill in the art that a number of elements in the present invention can have significantly different shapes and structure while still performing the same or similar functions as those described above. Such elements fall within the spirit and scope of the present invention. For example, the sleeve 22, 222 of the locking mechanism 10, 210 need not necessarily surround the lock cylinder 18, 218 as described above and illustrated in the figures. Instead, the sleeve 22, 222 can be any body or frame that can transmit axial force to the clutch disk 26 or actuator element 230 as described above, that has a cam surface as also described above, and that can transmit rotational force from the tumblers 82, 282 and sidebar (if employed) to the cam recesses 126 or projections 326 for generating disengagement from the housing 14, 214. As used herein and in the appended claims, the term "sleeve" refers to all such elements capable of functioning in this manner.

In the first illustrated embodiment, the cam recesses 126 of the sleeve 22 and the cam projections 50 of the housing 14 provide camming action that generates disengagement of the sleeve 22 from the housing 14 when sufficient torque is exerted upon the sleeve 22. In the second illustrated embodiment, the cam projections 326 of the sleeve 222 and the cam recesses 250 of the housing 214 provide camming action that generates disengagement of the sleeve 222 from the housing 214 when sufficient torque is exerted upon the sleeve 222. In this regard, any cam surface on the sleeve 22, 222 and any cooperating cam surface on the housing 14, 214 can be selected to cause axial separation of these elements in reaction to such torque. Specifically, cam recesses and cam projections can be located on the housing 14, 214 and sleeve 22, 222, respectively. In addition, the cam surfaces can be stepped, curved, ramped, or can take any shape capable of producing the axial displacement just described. If desired, multiple cam surfaces (e.g., multiple recesses, projections, steps, ramps, and the like) can be employed about the sleeve 22, 222 and the inside of the housing 14, 214 for the same purpose.

The above discussion regarding the dogs 302*a*, 302*b* and the actuator element 230 of FIGS. 11–18 applies equally to the embodiment of FIGS. 1–10. In this regard, the dogs 102*a*, 102*b* in the exemplary embodiment of FIGS. 1–10 are located at an end of the barrel portion 78 of the lock cylinder 18, and are spaced on opposite sides of the boss 98 extending from the barrel portion 78. It should be noted, however, that other elements and features of the lock cylinder 18 could be employed to selectively drivably engage the clutch disk 26 as described above. The bar-shaped dogs 102*a*, 102*b* illustrated in FIGS. 3 and 4 can be replaced by one or more elements having any shape that mates with one or more recesses in the clutch plate 26. By way of example only, the bar-shaped dogs 102*a*, 102*b* can be replaced by one or pins axially extending from the barrel portion 78 of the lock cylinder 18 into apertures in the clutch disk 26, one or more flanges or ribs that extend radially from the clutch disk 26 and that can be received within axially-extending recesses, grooves, or other apertures in the end of the barrel portion 78 of the lock cylinder 18, and the like. Any other engaging or mating elements on the lock cylinder 18 and clutch disk 26 can be employed for enabling the lock cylinder 18 to be releasably engaged with the clutch disk 26 for selectively transmitting rotational force from the lock cylinder 18 to the clutch disk 26.

As with the locking mechanism 210 illustrated in FIGS. 10–18, the engagement elements (e.g., dogs 102*a*, 102*b*) in the first illustrated embodiment can have the same shape as recesses in the clutch disk 26, although such a correspondence is not required to practice the present invention. In other embodiments, the lock cylinder 18 and clutch disk 26 have sufficient frictional engagement between one another that additional features or elements intended for transmitting rotational force to the clutch disk 26 are not necessary. It should also be noted that element(s) on the lock cylinder 18 for transmitting rotary force to the clutch disk 26 need not necessarily be located at the end of the barrel portion 78 of the lock cylinder 18, but can instead extend from or otherwise be located on the boss 98 of the lock cylinder 18.

What is claimed is:

1. A locking mechanism that affords actuation of a device only in response to the use of an appropriate key, the locking mechanism comprising:

a housing defining a cavity and having a central axis, the housing including a first end, a second end, and a first cam surface;

a sleeve received at least partially within the cavity, the sleeve including a second cam surface engageable with the first cam surface;

a lock cylinder received at least partially within the sleeve and having a locked configuration and an unlocked configuration, the locked configuration corresponding to the presence of the appropriate key in the lock cylinder;

a guide positioned substantially within the sleeve, the lock cylinder coupled for rotation with the guide when the lock cylinder is in the locked configuration and rotatable with respect to the guide when the lock cylinder is in the unlocked configuration; and an actuator releasably engagable with the lock cylinder, movable with respect to the housing, and adapted for driving connection with the device in the locked and unlocked states of the lock cylinder, the actuator engaged with the lock cylinder for rotation therewith when the lock cylinder is rotated in the unlocked configuration, and moved by the sleeve to a position disengaged from the lock cylinder when the lock cylinder is rotated in the locked configuration.

2. The locking mechanism of claim 1, wherein the lock cylinder is substantially secured against axial movement with respect to the housing.

3. The locking mechanism of claim 1, wherein the sleeve is axially slidable with respect to the guide and engages the guide for rotation therewith.

4. The locking mechanism of claim 1, wherein the lock cylinder includes a plurality of tumblers that are movable between an extended position and a retracted position, and wherein the tumblers move to the retracted position in response to insertion of the appropriate key into the lock cylinder.

5. The locking mechanism of claim 4, wherein the guide defines an engagement surface, and wherein in response to rotation of the lock cylinder in the locked configuration, the tumblers engage the engagement surface to thereby rotate the guide.

6. The locking mechanism of claim 1, wherein the cam surfaces are movable in camming contact with one another to axially move the sleeve when the lock cylinder is rotated in the locked configuration.

7. The locking mechanism of claim 6, wherein the actuator is positioned in the cavity and is axially moved by the sleeve to a position in which the actuator is disengaged from the lock cylinder, and wherein the guide, the sleeve, and lock cylinder are rotatable with respect to the actuator and the housing when the lock cylinder is in the locked configuration.

8. The locking mechanism of claim 1, wherein:

the actuator includes an axially recessed portion and the lock cylinder includes a radially extending dog; and the actuator is movable to and from a position in which the axially recessed portion receives the dog and the lock cylinder is engaged with the actuator.

9. The locking mechanism of claim 1, further comprising a biasing member at least partially received within the housing, the actuator having a biasing surface engageable with the biasing member to thereby bias the actuator toward a predetermined angular position with respect to the housing.

10. The locking mechanism of claim 1, wherein the actuator includes a coupling member and, wherein the housing includes a sidewall that defines an opening, and wherein the coupling member and at least part of the actuator extend through the opening for connection to the device.

11. The locking mechanism of claim 10, wherein the coupling member is a bowden cable.

12. The locking mechanism of claim 10, wherein the coupling member is a radially extending arm.

13. A lock assembly comprising:

a housing at least partially defining a cavity and having a central axis;

a lock cylinder received at least partially within the cavity and having a locked configuration wherein a projecting element extends from the lock cylinder, and an unlocked configuration wherein the projecting element is retracted with respect to the lock cylinder, the lock cylinder rotatable with respect to the housing in both the locked and unlocked configurations;

at least one guide defining at least two engagement surfaces and including a radially-extending drive projection, the projecting element extending between the engagement surfaces when the projecting element extends from the lock cylinder;

a sleeve received at least partially within the cavity and surrounding at least some of the projecting elements, the sleeve defining an aperture that receives the drive projection to non-rotatably couple the sleeve to the guide and to afford axial movement of the sleeve with respect to the guide; and an actuator selectively coupled to the lock cylinder for rotation therewith in response to rotation of the lock cylinder in one of the locked and unlocked configurations.

14. The locking mechanism of claim 13, wherein the sleeve moves axially when the lock cylinder is rotated in the locked configuration, thereby disengaging the actuator from the lock cylinder.

15. The locking mechanism of claim 13, wherein the sleeve cooperates with the housing when the lock cylinder is rotated in the locked configuration to disengage the actuator from the lock cylinder.

16. The locking mechanism of claim 13, wherein the at least one guide remains substantially axially fixed when the lock cylinder is rotated.

17. The locking mechanism of claim 13, wherein the actuator is biased into engagement with the lock cylinder.

18. The locking mechanism of claim 13, wherein the lock cylinder includes at least one drive dog and the actuator includes at least one recess, and wherein the drive dog engages the recess to couple the lock cylinder and the actuator for rotation together when the lock cylinder is rotated in the unlocked configuration.

19. The locking mechanism of claim 13, wherein:

the sleeve is slidably engageable with the actuator; and at least part of the sleeve is movable axially within the cavity.

20. The locking mechanism of claim 13, wherein the lock cylinder is substantially axially fixed with respect to the housing.

21. The locking mechanism of claim 13, wherein the housing includes a sidewall that defines an opening, and wherein the actuator includes a coupling member that extends through the opening.

22. The locking mechanism of claim 21, wherein the coupling member is a bowden cable.

23. The locking mechanism of claim 21, wherein the actuator has a radially extending arm.

24. A freewheeling locking mechanism comprising:

a housing defining a cavity and having a central axis;

an actuator rotatably coupled to the housing;

a lock cylinder received within the cavity and including a first set of retractable protrusions, and a second set of retractable protrusions that is diametrically opposed to the first set of retractable protrusions, the lock cylinder having an unlocked configuration corresponding to the presence of a properly coded key in the lock cylinder, and a locked configuration corresponding to the absence of the properly coded key in the lock cylinder, at least one of the retractable protrusions having a position extended from the lock cylinder when the lock cylinder is in the locked configuration and a position retracted within the lock cylinder when the lock cylinder is in the unlocked configuration, the lock cylinder being rotatable with respect to the housing in both the locked and unlocked configurations;

first and second diametrically opposed guides defining a pair of engagement surfaces for engagement with at least one retractable protrusion of a respective set of protrusions when the lock cylinder is rotated in the locked configuration;

a substantially cylindrical sleeve surrounding at least some of the retractable protrusions and at least a portion of the first and second guides, the sleeve non-rotatably coupled to the guides and axially movable with respect to the guides; and an actuator selectively coupled to the lock cylinder for rotation therewith in response to rotation of the lock cylinder in one of the locked and unlocked configurations.

25. The freewheeling locking mechanism of claim 24, wherein the sleeve moves axially when the lock cylinder is rotated in the locked configuration, thereby disengaging the actuator from the lock cylinder.

26. The freewheeling locking mechanism of claim 24, wherein the sleeve cooperates with the housing when the lock cylinder is rotated in the locked configuration to disengage the actuator from the lock cylinder.

27. The freewheeling locking mechanism of claim 24, wherein the guides remain substantially axially fixed when the lock cylinder is rotated.

28. The freewheeling locking mechanism of claim 24, wherein the actuator is biased into engagement with the lock cylinder.

29. The freewheeling locking mechanism of claim 24, wherein the lock cylinder includes at least one drive dog and the actuator includes at least one recess, and wherein the drive dog engages the recess to couple the lock cylinder and the actuator for rotation together when the lock cylinder is rotated in the unlocked configuration.

30. The freewheeling locking mechanism of claim 24, wherein the housing defines a first cam surface, and the sleeve defines a second cam surface, and wherein when the sleeve is rotated with respect to the housing, the first and second cam surfaces cooperate to move the sleeve axially with respect to the housing.

31. The freewheeling locking mechanism of claim 24, wherein the lock cylinder is substantially axially fixed with respect to the housing.

32. The freewheeling locking mechanism of claim 24, wherein the actuator includes a coupling member, and wherein the housing includes a sidewall that defines an opening through which a portion of the actuator and the coupling member extend.

33. The freewheeling locking mechanism of claim 32, wherein the coupling member is a bowden cable.

34. The freewheeling locking mechanism of claim 32, wherein the actuator has a radially extending arm.

* * * * *